US009529320B2

(12) United States Patent
Mori et al.

(10) Patent No.: US 9,529,320 B2
(45) Date of Patent: Dec. 27, 2016

(54) CARTRIDGE PROVIDED WITH PROTECTION COVER CAPABLE OF PROTECTING DEVELOPER CARRIER AND IMAGE FORMING APPARATUS PROVIDED WITH THE SAME

(71) Applicant: Brother Kogyo Kabushiki Kaisha, Nagoya-shi, Aichi-ken (JP)

(72) Inventors: Hiroki Mori, Nagoya (JP); Yasumasa Fujii, Chiryu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/938,621

(22) Filed: Nov. 11, 2015

(65) Prior Publication Data

US 2016/0062311 A1 Mar. 3, 2016

Related U.S. Application Data

(63) Continuation of application No. 14/673,184, filed on Mar. 30, 2015, now Pat. No. 9,213,308, which is a (Continued)

(30) Foreign Application Priority Data

Nov. 20, 2012 (JP) ..... 2012-254788

(51) Int. Cl.
*G03G 21/18* (2006.01)
*G03G 21/16* (2006.01)

(52) U.S. Cl.
CPC ..... *G03G 21/1814* (2013.01); *G03G 21/1647* (2013.01); *G03G 21/1803* (2013.01); *G03G 21/1821* (2013.01); *G03G 21/1828* (2013.01)

(58) Field of Classification Search
CPC . G03G 21/18; G03G 18/1821; G03G 21/1853
(Continued)

(56) References Cited

U.S. PATENT DOCUMENTS 8,311,451 B2 * 11/2012 Nishimura et al. ..... 399/119
8,521,058 B2 8/2013 Okabe et al.
(Continued)

FOREIGN PATENT DOCUMENTS

JP H07-104637 A 4/1995
JP 2000-019800 A 1/2000
(Continued)

OTHER PUBLICATIONS

May 26, 2015—(WO) International Preliminary Report on Patentability & Written Opinion of the ISA—App PCT/JP2012/081127, Eng Tran.

*Primary Examiner* — Hoang Ngo
(74) *Attorney, Agent, or Firm* — Banner & Witcoff, Ltd.

(57) ABSTRACT

A cartridge includes: a first cartridge; a second cartridge; and a protection cover. The first cartridge includes: a photosensitive body; a photosensitive-body accommodating portion for accommodating the photosensitive body; and a cartridge mounting portion. The second cartridge is detachably mounted in the first cartridge and includes a developer carrier. The protection cover provides an attached state to be attached to the second cartridge and a detached state to be detached from the second cartridge. The protection cover at the attached state faces the developer carrier to protect the developer carrier. The second cartridge provides an accommodated position to be accommodated in the cartridge mounting portion when the protection cover is at the attached state, and a mounted position to be mounted in the cartridge mounting portion when the protection cover is at the detached state.

21 Claims, 14 Drawing Sheets

Related U.S. Application Data continuation-in-part of application No. PCT/JP2012/081127, filed on Nov. 30, 2012.

(58) Field of Classification Search
USPC ..... 399/111, 113, 119
See application file for complete search history.

(56) References Cited

U.S. PATENT DOCUMENTS

| | | | |
|---|---|---|---|
| 8,521,059 | B2 | 8/2013 | Furuya et al. |
| 2010/0021203 | A1 | 1/2010 | Nishimura et al. |
| 2011/0229193 | A1 | 9/2011 | Okabe et al. |
| 2013/0022369 | A1 | 1/2013 | Nishimura et al. |

FOREIGN PATENT DOCUMENTS

| | | | |
|---|---|---|---|
| JP | 2004-198911 | A | 7/2004 |
| JP | 2005-091708 | A | 4/2005 |
| JP | 2006-267445 | A | 10/2006 |
| JP | 2006-337532 | A | 12/2006 |
| JP | 2007-199514 | A | 8/2007 |
| JP | 2010-026299 | A | 2/2010 |
| JP | 2010-152286 | A | 7/2010 |
| JP | 2011-197407 | A | 10/2011 |

* cited by examiner

CARTRIDGE PROVIDED WITH PROTECTION COVER CAPABLE OF PROTECTING DEVELOPER CARRIER AND IMAGE FORMING APPARATUS PROVIDED WITH THE SAME

CROSS REFERENCE TO RELATED APPLICATION

This application is a continuation of prior U.S. application Ser. No. 14/673,184, filed Mar. 30, 2015, which claims priority from Japanese Patent Application No. 2012-254788, filed Nov. 20, 2012. In addition, prior U.S. application Ser. No. 14/673,184, filed Mar. 30, 2015, is also a continuation-in-part of International Application No. PCT/JP2012/081127 filed Nov. 30, 2012 in Japan Patent Office as a Receiving Office. The entire contents of the prior applications are incorporated herein by reference.

TECHNICAL FIELD

The present disclosure relates to a cartridge that is accommodated in an image forming apparatus employing an electrophotographic system. The present disclosure also relates to an image forming apparatus that accommodates the cartridge therein.

BACKGROUND

There is known a printer, as an electrophotographic image forming apparatus, including a main casing, a drum unit, and a developing cartridge. The drum unit includes a photosensitive drum and is detachably mounted in the main casing. The developing cartridge is detachably mounted in the drum unit and includes a developing roller that supplies toner to the photosensitive drum. In this printer, the photosensitive drum and the developing roller are in contact with each other in a state where the developing cartridge is mounted in the drum unit.

In order to reduce a package size of such a printer at the time of transportation and shipment, for example, various methods have been proposed for transporting the printer in a state where the developing cartridge is mounted in the drum unit and the drum unit is accommodated in the main casing.

However, when the printer is transported in a state where the photosensitive drum and the developing roller are in contact with each other, such contact between the photosensitive drum and the developing roller may result in permanent deformation of the developing roller.

Thus, there has been proposed a printer provided with a separating member for separating a developing roller from a photosensitive drum. In this printer, the separating member is attached to a drum unit in which a developing cartridge is mounted.

Such a printer is transported in a state where the developing cartridge is mounted in the drum unit to which the separating member is attached and the drum unit is accommodated in a main casing. After transportation, the printer is installed at a predetermined installation place. The separating member is detached from the drum unit before the printer is used.

SUMMARY

In the printer described above, the separating member is necessary although it is only used during transportation of the printer. Thus, there is a limit on reduction in transportation cost.

In view of the foregoing, it is an object of the disclosure to provide a cartridge capable of reducing the package size of an image forming apparatus for transportation, capable of separating a developer carrier from a photosensitive body during transportation of the image forming apparatus, and capable of reducing the transportation cost of the image forming apparatus. It is another object of the disclosure to provide an image forming apparatus that accommodates the cartridge therein.

In order to attain the above and other objects, according to one aspect, the disclosure provides a cartridge including: a first cartridge; a second cartridge; and a protection cover. The first cartridge includes: a photosensitive body configured to rotate; a photosensitive-body accommodating portion configured to accommodate the photosensitive body therein; and a cartridge mounting portion. The second cartridge is configured to be detachably mounted in the first cartridge and includes a developer carrier configured to rotate to supply toner to the photosensitive body. The protection cover is configured to provide an attached state to be attached to the second cartridge and a detached state to be detached from the second cartridge. The protection cover at the attached state is configured to face the developer carrier to protect the developer carrier. The second cartridge is configured to provide an accommodated position to be accommodated in the cartridge mounting portion when the protection cover is at the attached state. The second cartridge is configured to provide a mounted position to be mounted in the cartridge mounting portion when the protection cover is at the detached state.

According to another aspect, the disclosure provides an image forming apparatus including: a cartridge; and a main casing. The cartridge includes: a first cartridge; a second cartridge; and a protection cover. The first cartridge includes: a photosensitive body configured to rotate; a photosensitive-body accommodating portion configured to accommodate the photosensitive body therein; and a cartridge mounting portion. The second cartridge is configured to be detachably mounted in the first cartridge and includes a developer carrier configured to rotate to supply toner to the photosensitive body. The protection cover is configured to provide an attached state to be attached to the second cartridge and a detached state to be detached from the second cartridge. The protection cover at the attached state is configured to face the developer carrier to protect the developer carrier. The second cartridge is configured to provide an accommodated position to be accommodated in the cartridge mounting portion when the protection cover is at the attached state. The second cartridge is configured to provide a mounted position to be mounted in the cartridge mounting portion when the protection cover is at the detached state. The main casing includes a cartridge accommodating portion configured to accommodate the cartridge. The cartridge is configured to be accommodated in the cartridge accommodating portion when the second cartridge is at the accommodated position.

BRIEF DESCRIPTION OF THE DRAWINGS

The particular features and advantages of the disclosure as well as other objects will become apparent from the following description taken in connection with the accompanying drawings, in which:

FIGS. 3A and 3B are side views of a process cartridge illustrated in FIG. 1, in which FIG. 3A is a right side view of the process cartridge, and FIG. 3B is a left side view of the process cartridge;

FIGS. 7A and 7B are side views of the process cartridge provided with the roller cover illustrated in FIG. 6, in which FIG. 7A is a right side view of the process cartridge, and FIG. 7B is a left side view of the process cartridge;

DETAILED DESCRIPTION

1. Overall Structure of Printer

Figure 1:
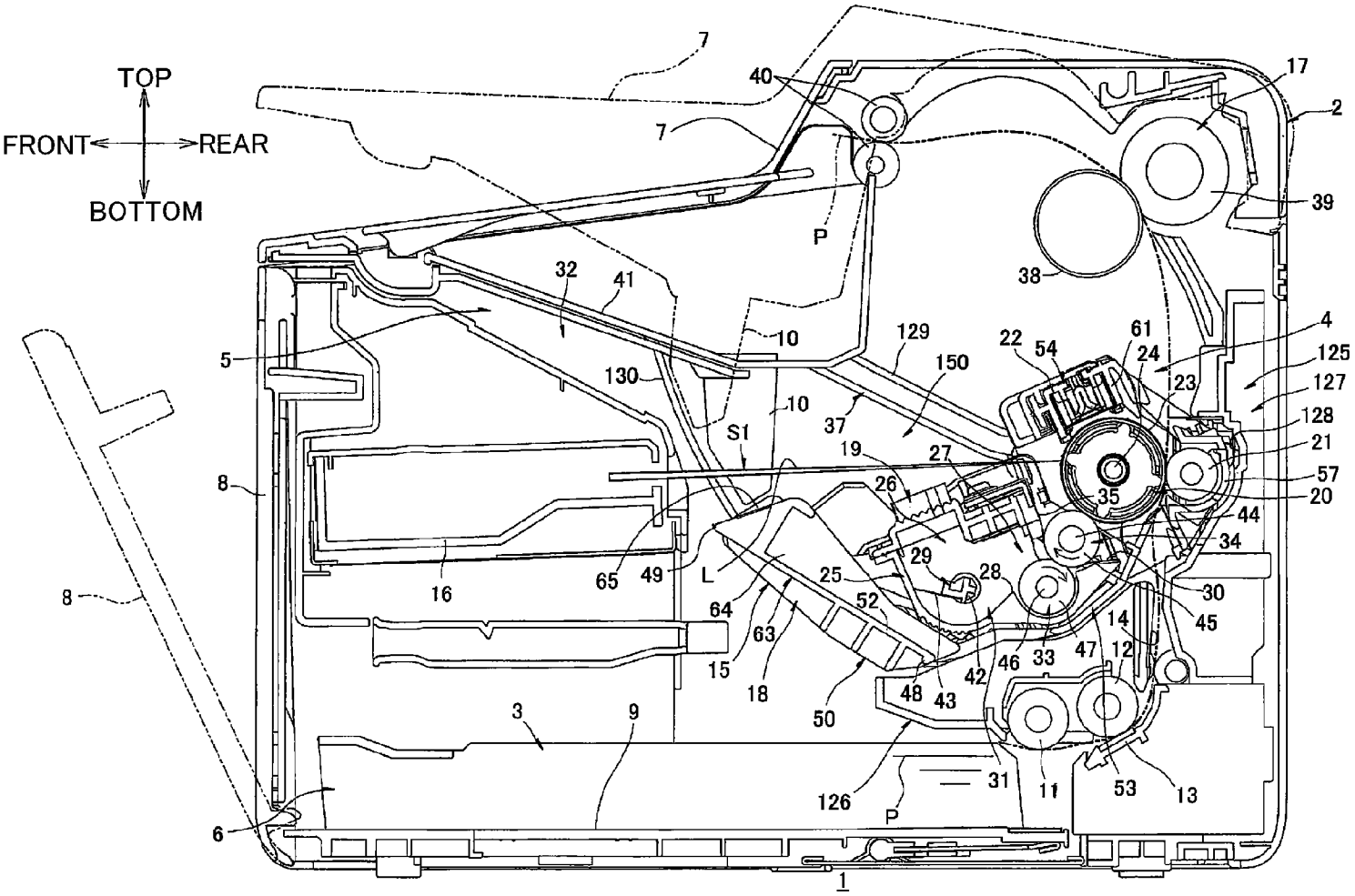
FIG. 1 is a central cross-sectional view of a printer according to a first embodiment.

FIG. 1 illustrates a printer 1 as an example of an image forming apparatus according to a first embodiment. The printer 1 is provided with a main casing 2 as an example of a main casing.

The main casing 2 has a generally box-like shape. In an internal space of the main casing 2, the printer 1 is also provided with a sheet-feeding unit 3 configured to feed sheets P of paper as a recording medium, and an image-forming unit 4 configured to form images on the sheets P supplied by the sheet-feeding unit 3.

In the following description, directions related to the printer 1 will be specified based on a state of the printer 1 when the printer 1 is resting on a level surface. Specifically, the left side and the right side in FIG. 1 will be referred to as the front side and the rear side of the printer 1, respectively. Further, the left side and the right side of the printer 1 will be based on the reference point of a user viewing the printer 1 from the front side. Specifically, the near side and the far side in FIG. 1 will be referred to as the right side and the left side of the printer 1, respectively. Still further, the top side and the bottom side in FIG. 1 will be referred to as the top side and the bottom side of the printer 1, respectively.

Incidentally, a left-right direction is an example of an axial direction. Further, a top-bottom direction is an example of an orthogonal direction.

(1) Main Casing

Formed in the main casing 2 are a cartridge access opening 5 and a paper-introducing opening 6.

The cartridge access opening 5 is formed in an upper end portion of the main casing 2, and penetrates the upper end portion in a vertical direction. The cartridge access opening 5 is provided for mounting and removing a process cartridge 15 (described later).

The paper-introducing opening 6 is formed in a front end portion of the main casing 2 at its bottom portion, and penetrates the front end portion in a front-rear direction. Through the paper-introducing opening 6, the sheets P of paper are inserted into the main casing 2.

The main casing 2 also includes a top cover 7 as an example of an access cover disposed on the upper end portion thereof, and a sheet-feeding cover 8 disposed on the front end portion thereof.

The top cover 7 is elongated in the front-rear direction. Pressing portions 10 are provided on a bottom surface of the top cover 7 in an approximate front-rear center region thereof.

Figure 10:
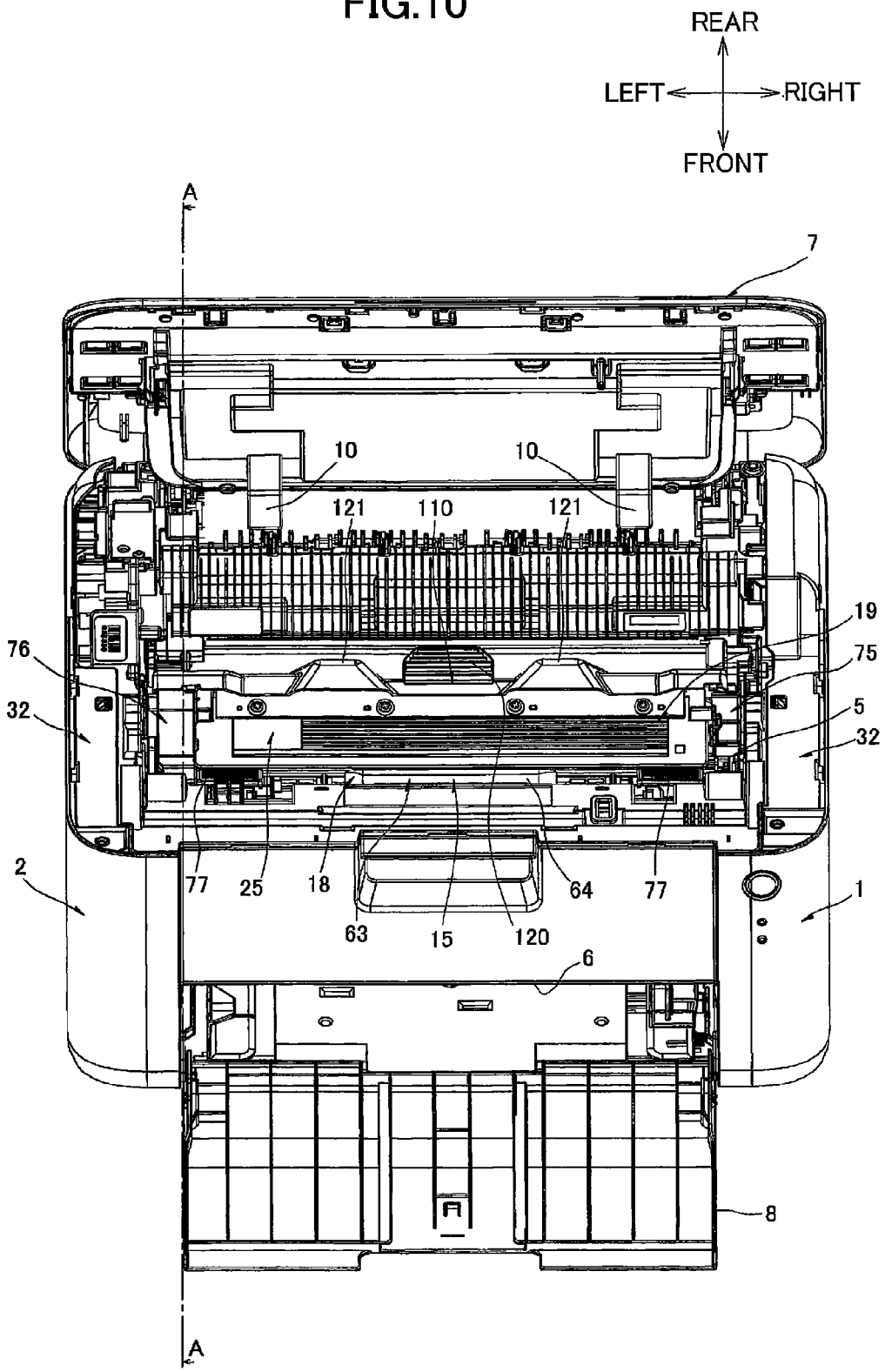
FIG. 10 is a perspective view of the printer illustrated in FIG. 1 as viewed from its upper-front side.

As illustrated in FIG. 10, a plurality of (two in the embodiment) pressing portions 10 is provided to correspond to a pair of pressure-receiving portions 65 (described later). More specifically, the two pressing portions 10 are spaced apart from each other in a left-right direction. The pressing portions 10 have a general rectangular shape in a side view and are elongated in the left-right direction. The pressing portions 10 are formed on the bottom surface of the top cover 7 and protrude downward therefrom.

The top cover 7 is provided so as to be capable of pivotally moving about its rear edge portion between a closed position for covering the cartridge access opening 5 (see FIG. 1), and an open position for exposing the cartridge access opening 5 (see FIG. 10).

The sheet-feeding cover 8 is provided so as to be capable of pivotally moving about its bottom edge portion between a closed position for covering the paper-introducing opening 6 (see FIG. 1), and an open position for exposing the paper-introducing opening 6 (see FIG. 10).

Note that, in FIG. 1, the top cover 7 and the sheet-feeding cover 8 disposed in the closed position are depicted by solid lines, while the top cover 7 and the sheet-feeding cover 8 disposed between the closed position and the open position are depicted by chain double-dashed lines.

(2) Sheet-Feeding Unit

The sheet-feeding unit 3 includes a sheet-supporting portion 9 provided in a lower portion of the main casing 2, as illustrated in FIG. 1. The sheet-supporting portion 9 is in communication with an exterior of the main casing 2 through the paper-introducing opening 6.

The sheets P of paper are placed in the sheet-feeding unit 3 when the sheet-feeding cover 8 is in its open position. More specifically, the sheets P are inserted through the paper-introducing opening 6 such that front portions of the sheets P are stacked on a top surface of the sheet-feeding cover 8 and rear portions of the sheets P are stacked in the sheet-supporting portion 9.

The sheet-feeding unit 3 further includes a pickup roller 11, a feeding roller 12, and a feeding pad 13.

(3) Image-Forming Unit

The image-forming unit 4 includes the process cartridge 15, a scanning unit 16 as an example of an exposure device, and a fixing unit 17.

The process cartridge 15 can be mounted in and removed from the main casing 2. When mounted in the main casing 2, the process cartridge 15 is arranged above a rear portion of the sheet-feeding unit 3. The process cartridge 15 includes a drum cartridge 18 as an example of a first cartridge and a developing cartridge 19 as an example of a second cartridge.

The drum cartridge 18 can be mounted in and removed from the main casing 2. The drum cartridge 18 includes a photosensitive drum 20 as an example of a photosensitive body, a transfer roller 21, and a scorotron charger 22.

The photosensitive drum 20 is provided in a rear portion of the drum cartridge 18 so as to be capable of rotating.

The transfer roller 21 is disposed on a rear side of the photosensitive drum 20 so as to contact the photosensitive drum 20 with pressure on the rear side thereof. The transfer roller 21 is provided in the drum cartridge 18 so as to be capable of rotating.

The scorotron charger 22 is arranged to confront the photosensitive drum 20 on an upper-front side thereof and with a gap therebetween.

The developing cartridge 19 can be attached to and detached from the drum cartridge 18. The developing cartridge 19 is disposed on a lower front side of the photosensitive drum 20. The developing cartridge 19 includes a developing-cartridge frame 25.

The developing-cartridge frame 25 has a generally box-like shape that is elongated in the left-right direction. The developing-cartridge frame 25 has a rear end portion formed with an opening 30 extending in the left-right direction. A toner-accommodating chamber 26 and a development chamber 27 are formed in the developing-cartridge frame 25. The toner-accommodating chamber 26 and the development chamber 27 are provided side by side in the front-rear direction, with a communication opening 28 allowing communication between the toner-accommodating chamber 26 and the development chamber 27.

The toner-accommodating chamber 26 accommodates toner as an example of developer. An agitator 29 is provided in an approximate front-rear and vertical center region of the toner-accommodating chamber 26.

The agitator 29 includes an agitator shaft 42 extending in the left-right direction and an agitating blade 43 extending outward from the agitator shaft 42 in a radial direction of the agitator shaft 42. The agitator 29 is supported in the developing-cartridge frame 25 such that end portions of the agitator shaft 42 are rotatably supported in developing-cartridge side walls 31 of the developing-cartridge frame 25, respectively. The end portions of the agitator shaft 42 protrude outward in the left-right direction from the developing-cartridge side walls 31, respectively.

Provided in the development chamber 27 are a developing roller 34 as an example of a developer carrier, a supply roller 33, and a thickness-regulating blade 35.

The developing roller 34 includes a developing roller shaft 44 extending in the left-right direction and a rubber roller body 45 covering the developing roller shaft 44 such that end portions of the developing roller shaft 44 are exposed outside the rubber roller body 45. The developing roller 34 is disposed such that a rear portion of the rubber roller body 45 is exposed outside the developing-cartridge frame 25 through the opening 30 and contacts the photosensitive drum 20 on a lower-front side thereof. Further, the developing roller 34 is supported in the developing-cartridge frame 25 such that the end portions of the developing roller shaft 44 are rotatably supported in the developing-cartridge side walls 31 of the developing-cartridge frame 25, respectively. The end portions of the developing roller shaft 44 protrude outward in the left-right direction from the developing-cartridge side walls 31, respectively.

The supply roller 33 includes a supply roller shaft 46 extending in the left-right direction and a sponge roller body 47 covering the supply roller shaft 46 such that end portions of the supply roller shaft 46 are exposed outside the sponge roller body 47. The supply roller 33 is disposed such that the sponge roller body 47 contacts the rubber roller body 45 on a lower-front side thereof with pressure. Further, the supply roller 33 is supported in the developing-cartridge frame 25 such that the end portions of the supply roller shaft 46 are rotatably supported in the developing-cartridge side walls 31 of the developing-cartridge frame 25, respectively. The end portions of the supply roller shaft 46 protrude outward in the left-right direction from the developing-cartridge side walls 31, respectively.

The thickness-regulating blade 35 is supported in the developing-cartridge frame 25 so as to contact the developing roller 34 from a front side thereof.

The scanning unit 16 is arranged frontward of the process cartridge 15 mounted in the main casing 2. The scanning unit 16 irradiates a laser beam L toward the photosensitive drum 20 based on image data. The laser beam L passes through an exposure space S1 defined in the main casing 2 at a position above the developing cartridge 19 and between the scanning unit 16 and the photosensitive drum 20. A circumferential surface of the photosensitive drum 20 is exposed to the laser beam L past the exposure space S1.

The fixing unit 17 is disposed in the main casing 2 at a position above the rear portion of the drum cartridge 18. The fixing unit 17 includes a heating roller 38, and a pressure roller 39 contacting the heating roller 38 on an upper-rear side thereof with pressure.

(4) Image-Forming Operation

The agitator 29 rotates to supply toner from the toner-accommodating chamber 26 of the developing cartridge 19 to the supply roller 33 through the communication opening 28. The supply roller 33 in turn supplies the toner onto the developing roller 34, at which time the toner is positively tribocharged between the supply roller 33 and the developing roller 34.

The thickness-regulating blade 35 regulates the thickness of toner supplied to the developing roller 34 as the developing roller 34 rotates so that a thin layer of toner of uniform thickness is carried on the surface of the developing roller 34.

In the meantime, the scorotron charger 22 uniformly charges the surface of the photosensitive drum 20. The scanning unit 16 subsequently exposes the surface of the photosensitive drum 20 to the laser beam L, forming an electrostatic latent image on the circumferential surface of the photosensitive drum 20 based on image data. Next, the toner carried on the developing roller 34 is supplied to the electrostatic latent image on the circumferential surface of the photosensitive drum 20 so that a toner image is carried on the circumferential surface of the photosensitive drum 20.

The rotating pickup roller 11 supplies the sheets P stacked on the sheet-supporting portion 9 between the feeding roller 12 and the feeding pad 13, and the rotating feeding roller 12 separates the sheets P, conveys each separated sheet P onto a feeding path 14 extending in the vertical direction, and supplies the sheets P one at a time to a position between the photosensitive drum 20 and the transfer roller 21 at a prescribed timing. As the sheet P passes between the photosensitive drum 20 and the transfer roller 21, the toner image is transferred from the photosensitive drum 20 onto the sheet P, forming an image on the sheet P.

Next, the sheet P passes between the heating roller 38 and the pressure roller 39. At this time, the heating roller 38 and the pressure roller 39 apply heat and pressure to the sheet P to thermally fix the image to the sheet P. The sheet P is subsequently conveyed toward a pair of discharge rollers 40. The discharge rollers 40 discharge the sheet P onto a discharge tray 41 formed on a top surface of the top cover 7.

In this way, the sheet P is supplied from the sheet-supporting portion 9 and conveyed along a conveying path that has a general C-shape in a side view, passing first between the photosensitive drum 20 and the transfer roller 21 and next between the heating roller 38 and the pressure roller 39, and subsequently being discharged onto the discharge tray 41.

2. Detailed Description of Process Cartridge

Figure 3A:
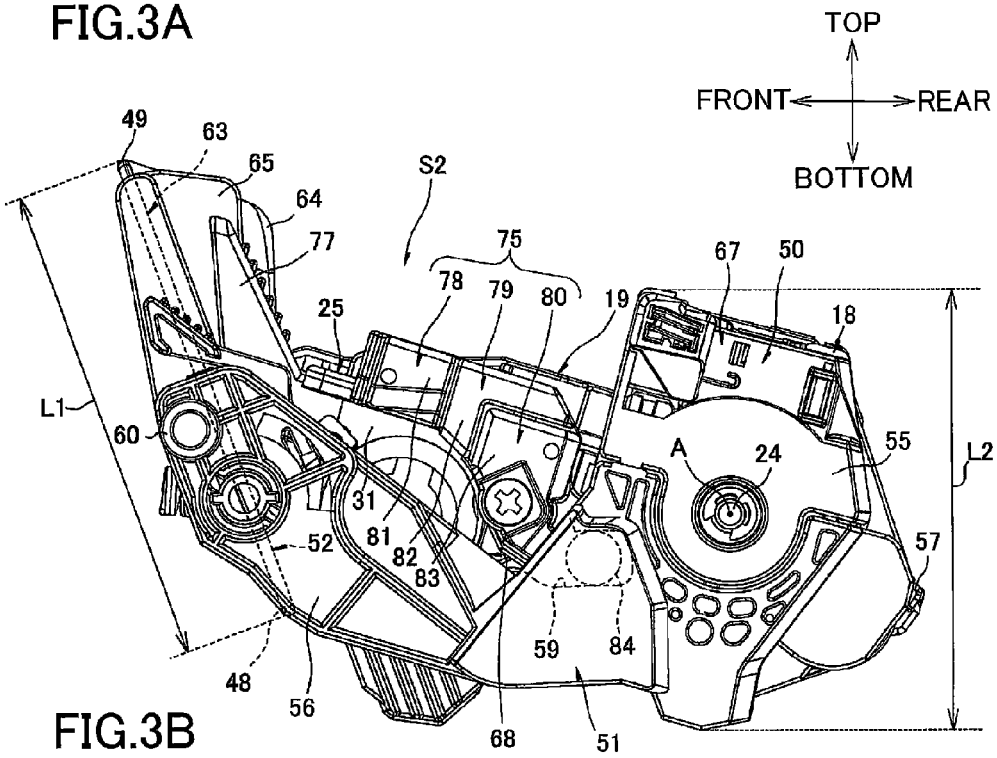
Figure 3B:
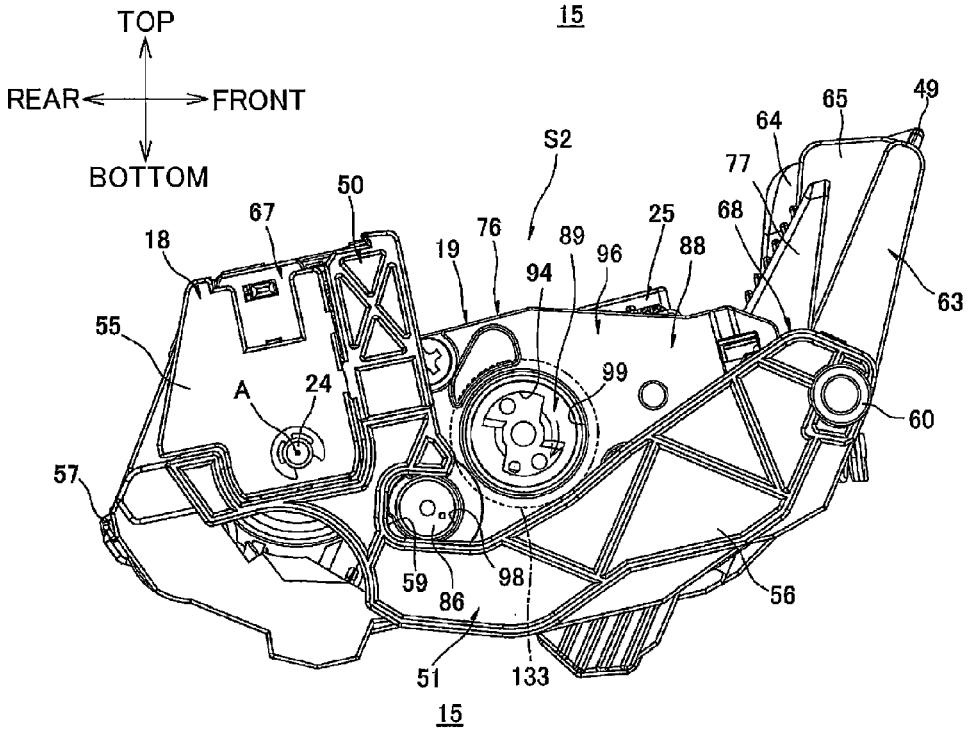

As illustrated in FIGS. 3A and 3B, the process cartridge 15 includes the drum cartridge 18 and the developing cartridge 19.

In the following description of the process cartridge 15, when directions are described, the side on which the photosensitive drum 20 is disposed will be referred to as the rear side of the process cartridge 15 and the side on which the scorotron charger 22 is disposed will be referred to as the top side. That is, the top, bottom, front, rear directions related to the process cartridge 15 slightly differ from the top, bottom, front, rear directions related to the printer 1. When the process cartridge 15 is mounted in the printer 1, the front side of the process cartridge 15 faces the lower-front side of the printer 1, and the rear side of the process cartridge 15 faces the upper-rear side of the printer 1, as illustrated in FIG. 1.

(1) Drum Cartridge

Figure 2:
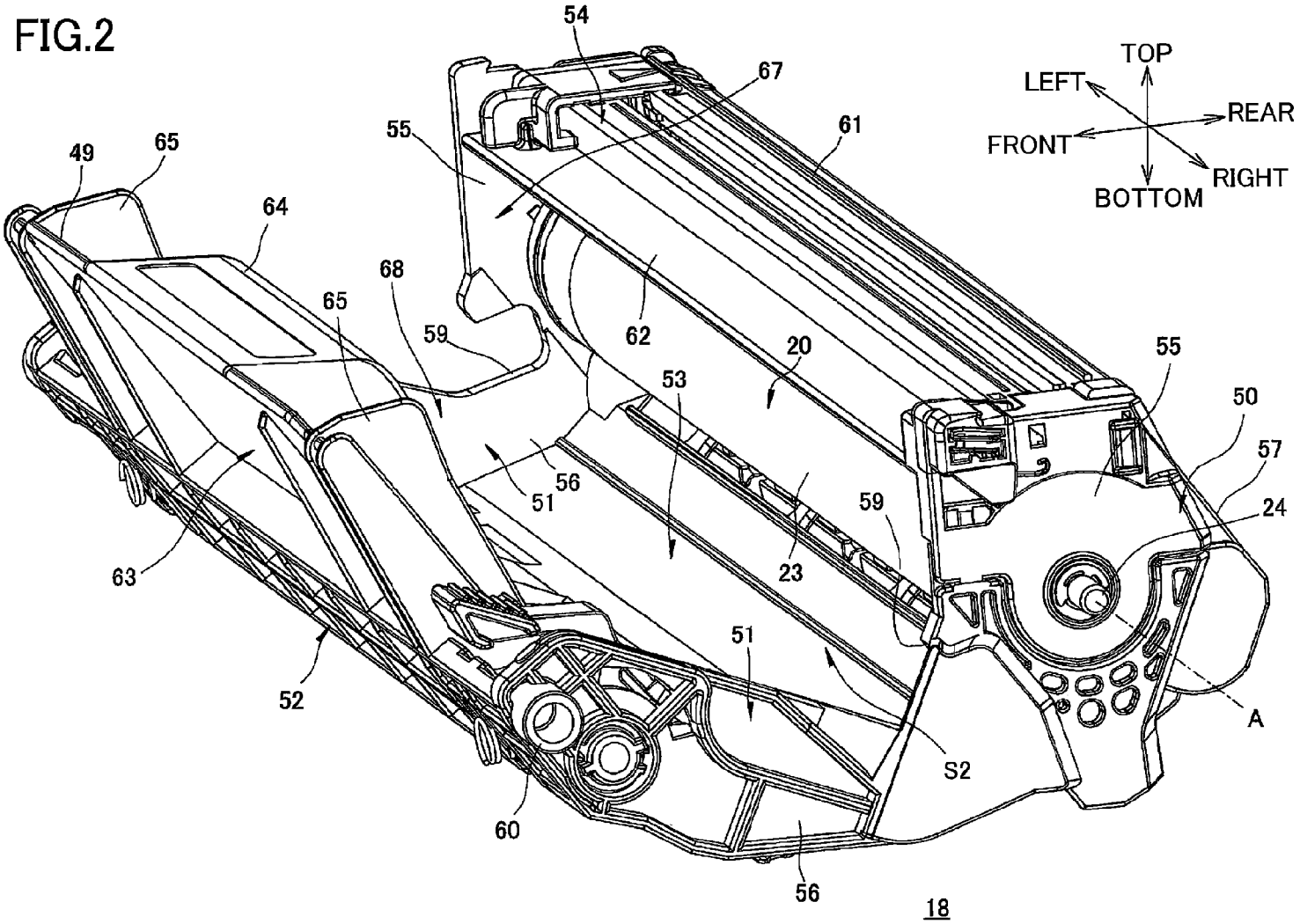
FIG. 2 is a perspective view of a drum cartridge illustrated in FIG. 1 as viewed from its upper-right side.

As illustrated in FIG. 2, the drum cartridge 18 is provided with a drum frame 50.

(1-1) Drum Frame

The drum frame 50 has a frame-like structure with a closed bottom and is generally rectangular in a plan view. The drum frame 50 is formed of a resin material such as a polymer alloy obtained by mixing polycarbonate and polystyrene or a polymer alloy obtained by mixing polycarbonate and acrylonitrile-butadiene-styrene. Specifically, the drum frame 50 has a pair of left and right drum side walls 51, a drum bottom wall 53 as an example of a connecting portion, a drum front wall 52, a drum rear wall 57, a drum top wall 54, and an extension portion 63.

The pair of drum side walls 51 is arranged to face and be spaced apart from each other in the left-right direction. Each of the pair of drum side walls 51 has an accommodating-portion side wall 55 constituting a rear portion thereof and a mounting-portion side wall 56 constituting a front portion thereof. The accommodating-portion side wall 55 and the mounting-portion side wall 56 are integral with each other.

The accommodating-portion side wall 55 is formed in a generally plate shape that is generally rectangular in a side view. The mounting-portion side wall 56 is formed in a generally rectangular shape in a side view, extending diagonally upward and frontward continuously from a front edge of the accommodating-portion side wall 55 at a lower portion thereof.

As illustrated in FIGS. 3A and 3B, each of the pair of drum side walls 51 is formed with a collar-receiving groove 59 as an example of a cartridge guide portion. The collar-receiving groove 59 is formed in a front end portion of the accommodating-portion side wall 55 at a position above a region where the accommodating-portion side wall 55 is connected to the mounting-portion side wall 56. The collar-receiving groove 59 has a general U-shape in a side view, recessed frontward from a front edge of the accommodating-portion side wall 55. Moreover, the collar-receiving groove 59 has a lower surface that is continuous to an upper surface of the mounting-portion side wall 56.

Each of the pair of drum side walls 51 is integrally provided with a guide boss 60. As illustrated in FIG. 2, the guide boss 60 is disposed at an outer left-right surface of the mounting-portion side wall 56 at a front end portion thereof. The guide boss 60 has a general cylindrical shape protruding outward in the left-right direction from the outer left-right surface of the mounting-portion side wall 56.

Figure 8:
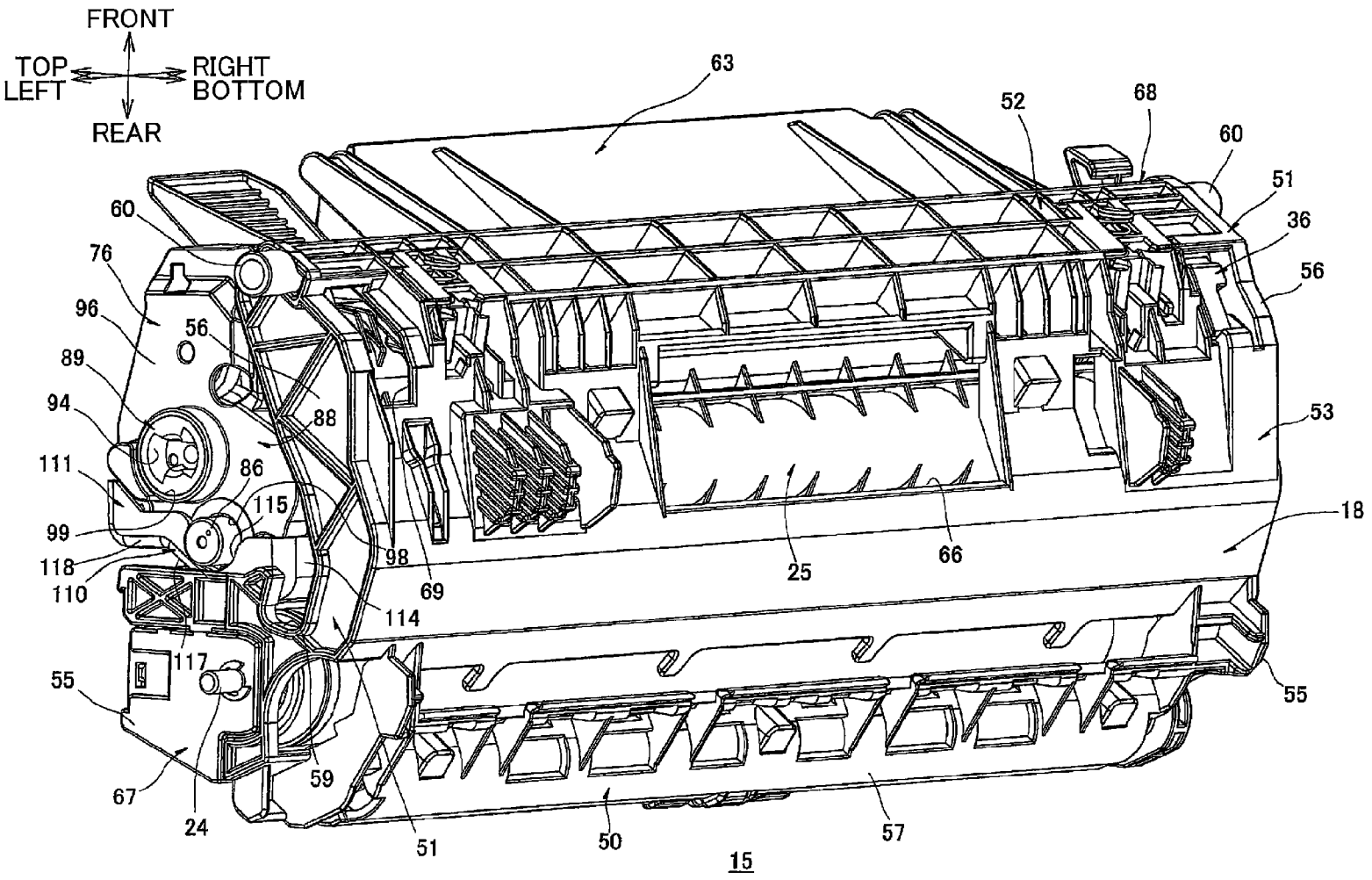
FIG. 8 is a perspective view of the process cartridge provided with the roller cover illustrated in FIG. 6 as viewed from its lower-left side.

As illustrated in FIG. 8, the drum bottom wall 53 bridges bottom edges of the pair of drum side walls 51. The drum bottom wall 53 has a general plate shape in a bottom view that is elongated in the left-right direction.

The drum bottom wall 53 is formed with an opening 66. The opening 66 is formed at a front end portion of the drum bottom wall 53 in an approximate left-right center region thereof. The opening 66 has a general rectangular shape in a bottom view that is elongated in the left-right direction. The opening 66 penetrates the front end portion of the drum bottom wall 53.

The drum front wall 52 bridges front edges of the mounting-portion side walls 56 of the pair of drum side walls 51. The drum front wall 52 has a base end 48 at its bottom end. The base end 48 is connected to a front edge of the drum bottom wall 53. That is, the opening 66 is formed in a continuous portion 36 between the drum front wall 52 and the drum bottom wall 53 on an approximately left-right center region thereof. With this configuration, the drum front wall 52 can be resiliently deformed so as to bend in the front-rear direction. Moreover, as illustrated in FIG. 3A, the drum front wall 52 is formed continuously from a front edge of the drum bottom wall 53 and is inclined forward toward the top.

As illustrated in FIG. 2, the extension portion 63 is provided integral with the drum front wall 52. A combination of the drum front wall 52 and the extension portion 63 constitutes an example of an extending portion.

As illustrated in FIGS. 2 and 3A, the extension portion 63 is formed continuously with a top edge of the drum front wall 52 at an approximate left-right center region thereof. The extension portion 63 has a free end 49 at its top end. The extension portion 63 is inclined forward toward the top along an inclination substantially equivalent to the inclination of the drum front wall 52.

That is, the drum front wall 52 and the extension portion 63 are inclined such that the free end 49 of the extension portion 63 is positioned farther away from the photosensitive drum 20 than the base end 48 of the drum front wall 52 from the photosensitive drum 20. Moreover, a length L1 from the base end 48 of the drum front wall 52 to the free end 49 of the extension portion 63 is set to be greater than a length L2 of a drum-accommodating portion 67 (described later) in the vertical direction. The length L1 from the base end 48 to the free end 49 is an example of a first length, while the vertical length L2 of the drum-accommodating portion 67 is an example of a second length.

The extension portion 63 is integrally provided with a handle portion 64 and the pressure-receiving portions 65.

As illustrated in FIG. 2, the handle portion 64 is formed in a general square cylindrical shape that protrudes rearward from a rear surface of the extension portion 63 at an approximate left-right center portion thereof.

The pressure-receiving portions 65 are provided on the rear surface of the extension portion 63, with one on each of left and right end portions thereof. The pressure-receiving portions 65 respectively face but are spaced apart from left and right ends of the handle portion 64 from outer left-right sides thereof. The pressure-receiving portions 65 are formed in a general plate shape that is substantially rectangular in a side view and protrude rearward from the rear surface of the extension portion 63.

As illustrated in FIG. 8, the drum rear wall 57 bridges rear edges of the accommodating-portion side walls 55 of the pair of drum side walls 51. As illustrated in FIG. 1, the drum rear wall 57 is formed in a general plate shape having a substantially U-shape in a cross-sectional view with an opening of the "U" facing frontward. The transfer roller 21 is rotatably accommodated on an interior of the drum rear wall 57.

As illustrated in FIG. 2, the drum top wall 54 bridges top edges of the accommodating-portion side walls 55 of the pair of drum side walls 51. The drum top wall 54 is integrally provided with a charger-supporting portion 61 and a rib 62.

The charger-supporting portion 61 is formed in a general U-shape in a cross-sectional view with an opening of the "U" facing downward as illustrated in FIG. 1, and is elongated in the left-right direction as illustrated in FIG. 2. Moreover, left and right ends of the charger-supporting portion 61 are respectively connected to the inner left-right surfaces of the accommodating-portion side walls 55. Further, the scorotron charger 22 is supported inside the charger-supporting portion 61, as illustrated in FIG. 1.

As illustrated in FIG. 2, the rib 62 has a general plate shape, elongated in the left-right direction and protruding frontward from a front surface of the charger-supporting portion 61 in an approximate front-rear center region thereof. Moreover, left and right ends of the rib 62 are connected to the inner left-right surfaces of the accommodating-portion side walls 55. Further, the rib 62 and the extension portion 63 of the drum front wall 52 are arranged so as to face each other in the front-rear direction with a gap therebetween.

As illustrated in FIG. 2, the drum frame 50 has a rear portion constituting a drum-accommodating portion 67 as an example of a photosensitive-body accommodating portion. The drum frame 50 has a front portion constituting a cartridge-mounting portion 68 as an example of a cartridge mounting portion.

The drum-accommodating portion 67 is defined by the pair of accommodating-portion side walls 55, a rear portion of the drum bottom wall 53, the drum rear wall 57, and the drum top wall 54. The drum-accommodating portion 67 has a general box-like shape that is open on a front side thereof. That is, the rib 62 of the drum top wall 54 protrudes toward the cartridge-mounting portion 68.

The photosensitive drum 20 is accommodated in the drum-accommodating portion 67.

The photosensitive drum 20 includes a drum body 23 and a drum shaft 24. The drum body 23 is formed in a general cylindrical shape extending in the left-right direction. A photosensitive layer made of resin is formed on a circumferential surface of the drum body 23 so as to coat the circumferential surface. The drum shaft 24 is formed in a general columnar shape extending in the left-right direction. The drum shaft 24 extends through the drum body 23 so as to be capable of rotating relative to the drum body 23, with its central axis aligned with a central axis of the drum body 23. That is, the drum shaft 24 is coaxial with the drum body 23.

The photosensitive drum 20 is supported in the drum-accommodating portion 67, with left and right end portions of the drum shaft 24 supported in an approximate center portions of the corresponding accommodating-portion side walls 55 so as to be incapable of rotating relative thereto. Moreover, the left and right end portions of the drum shaft 24 penetrate the corresponding accommodating-portion side walls 55 and protrude outward in the left-right direction therefrom.

With this arrangement, the photosensitive drum 20 is provided at the drum frame 50 so as to be capable of rotating relative to the drum frame 50 about a rotation axis A identical to the central axis of the drum body 23. Moreover, as illustrated in FIGS. 3A and 3B, the collar-receiving groove 59 is disposed closer to the drum bottom wall 53 than the rotation axis A to the drum bottom wall 53. More specifically, the collar receiving groove 59 is positioned further downward than the rotation axis A As illustrated in FIG. 2, the cartridge-mounting portion 68 is defined by the pair of mounting-portion side walls 56, a front portion of the drum bottom wall 53, the drum front wall 52, and the drum-accommodating portion 67. The cartridge-mounting portion 68 has a general box-like shape that is open on a top side thereof. That is, the drum bottom wall 53 connects the cartridge-mounting portion 68 and the drum front wall 52.

The cartridge-mounting portion 68 has a mounting space S2 for attachment and detachment of the developing cartridge 19. The mounting space S2 is defined between the extension portion 63 and the drum-accommodating portion 67 in the front-rear direction.

The cartridge-mounting portion 68 has a detected gear exposure opening 69. As illustrated in FIG. 8, the detected gear exposure opening 69 is formed in a left end portion of the drum frame 50 on a lower-front end thereof. The detected gear exposure opening 69 has a general rectangular shape in a bottom view that is elongated in the front-rear direction across a front end portion of the drum bottom wall 53 and a lower end portion of the drum front wall 52. The detected gear exposure opening 69 penetrates the front end portion of the drum bottom wall 53 and the lower end portion of the drum front wall 52.

(2) Developing Cartridge

Figure 5:
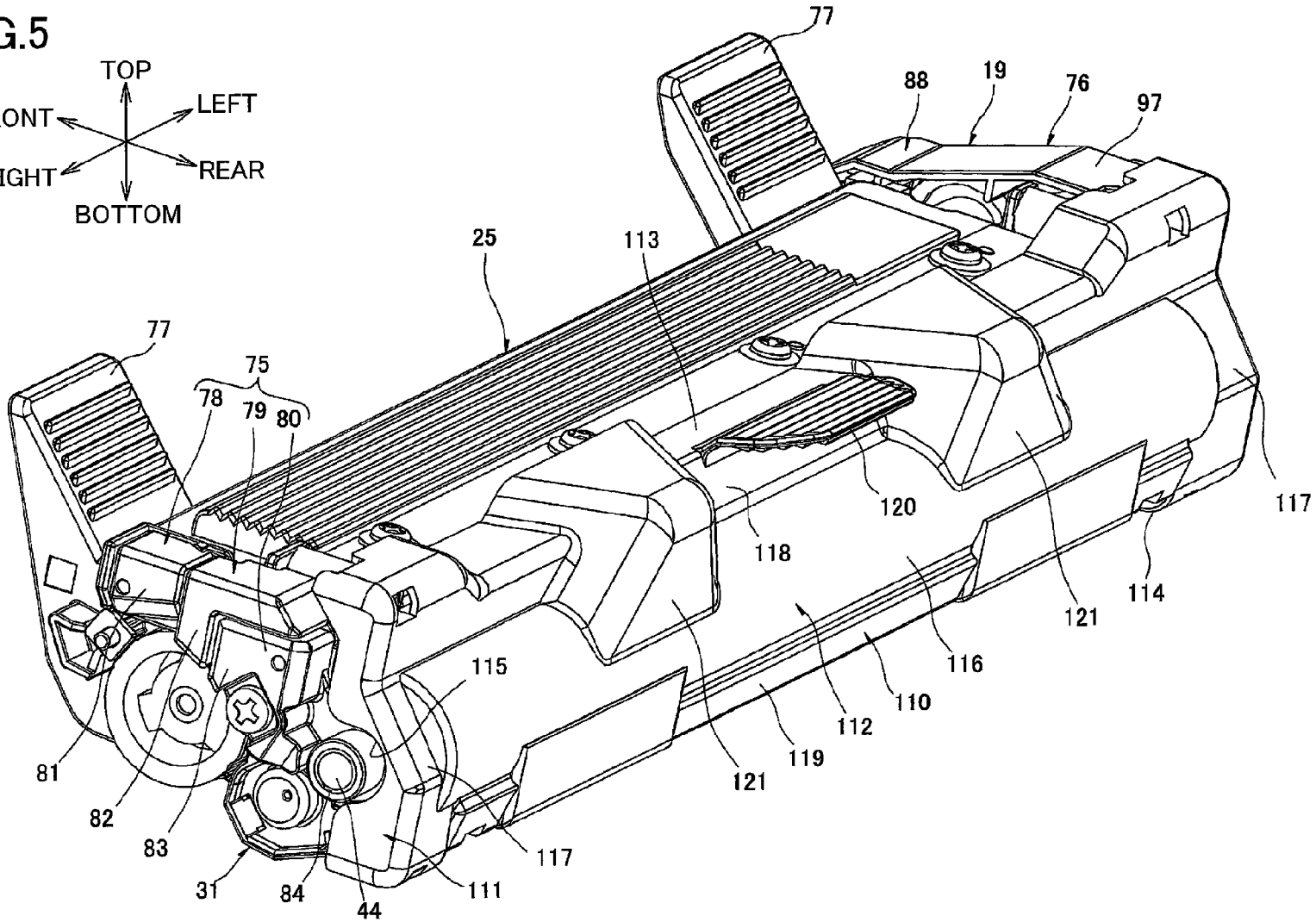
FIG. 5 is a perspective view of a developing cartridge illustrated in FIGS. 3A and 3B to which a roller cover is mounted as viewed from its upper-right side.

As illustrated in FIG. 5, the developing cartridge 19 includes the developing-cartridge frame 25, a power supply unit 75 disposed on a right side of the developing-cartridge frame 25, and a drive unit 76 disposed on a left side of the developing-cartridge frame 25.

Figure 4:
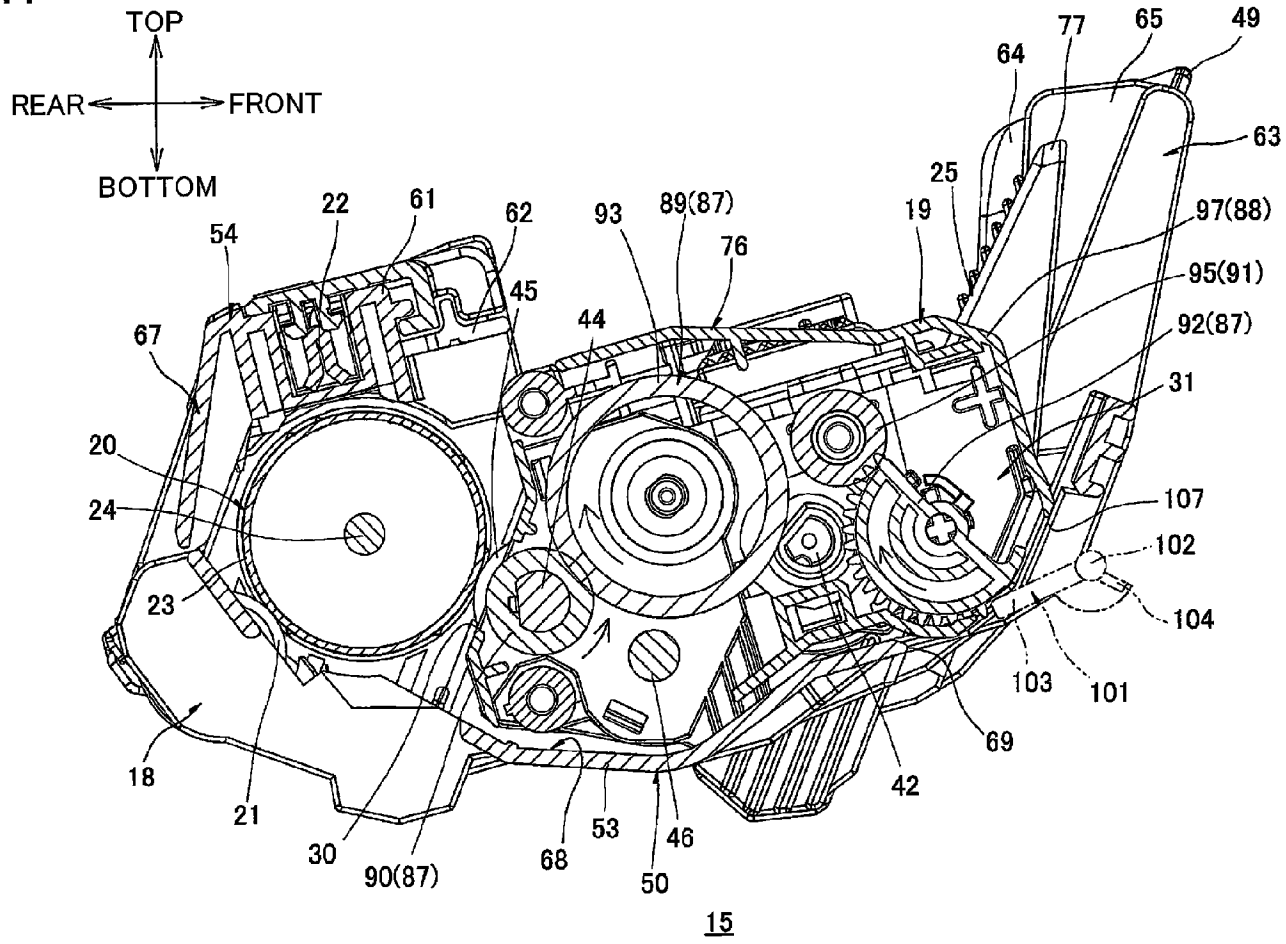
FIG. 4 is a side cross-sectional view of a drive unit illustrated in FIG. 3B.

As illustrated in FIGS. 4 and 5, the developing-cartridge frame 25 has the pair of developing-cartridge side walls 31. The developing-cartridge side walls 31 are spaced apart from and oppose each other in the left-right direction.

Figure 9:
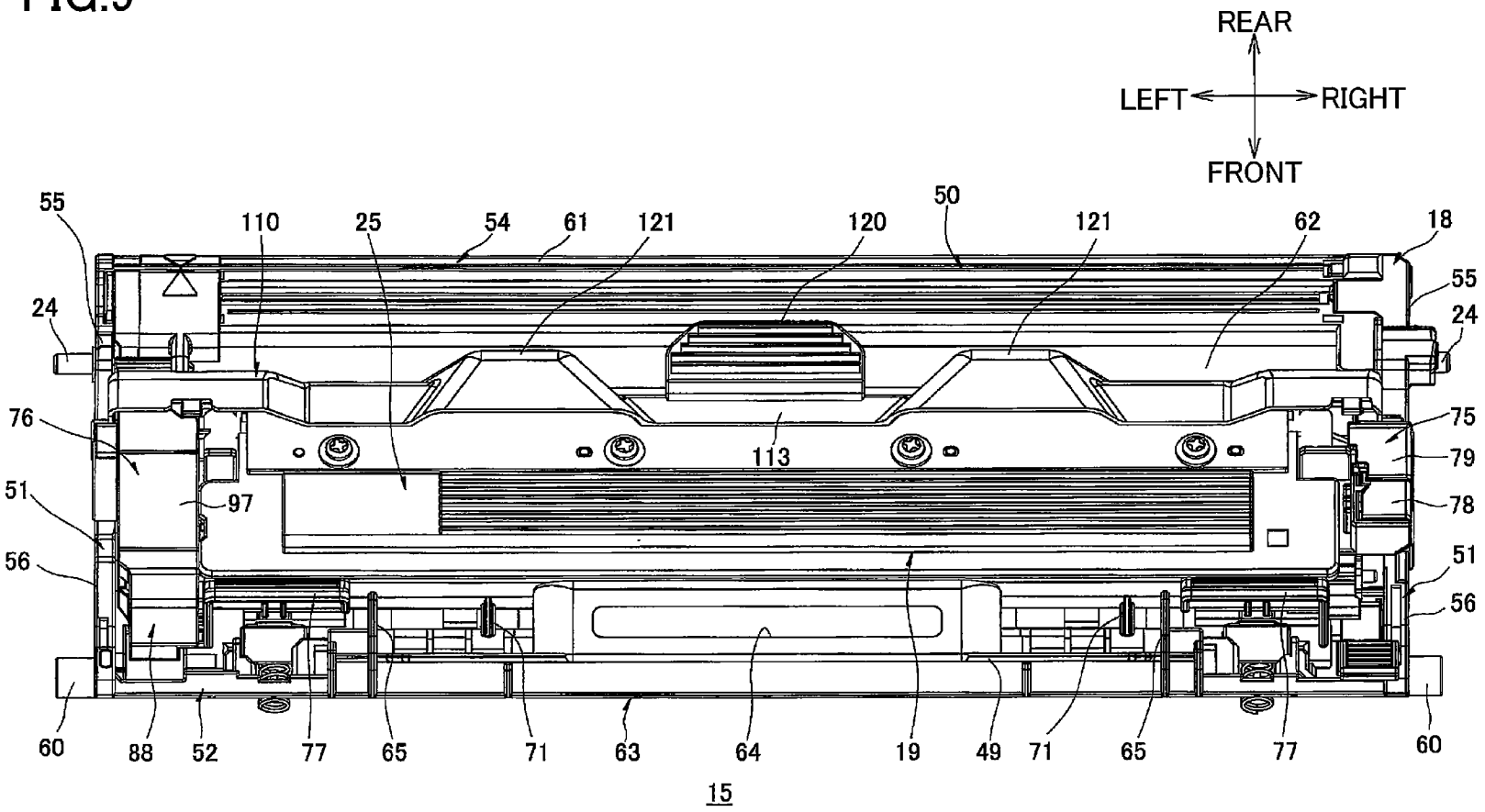
FIG. 9 is a top plan view of the process cartridge provided with the roller cover illustrated in FIG. 6.

As illustrated in FIG. 9, a pair of developing-cartridge grip portions 77 as an example of a pair of grip portions and a plurality of protruding portions 71 are integrally provided on a front end portion of the developing-cartridge frame 25.

As illustrated in FIG. 5, the developing-cartridge grip portions 77 are formed in a general plate shape that is substantially rectangular in a rear view. The developing-cartridge grip portions 77 are provided on a front wall of the developing-cartridge frame 25, with one on each of left and right end portions thereof. Moreover, as illustrated in FIGS. 3A and 3B, the developing-cartridge grip portions 77 are formed continuously from a top edge of the front wall of the developing-cartridge frame 25 and are inclined obliquely upward toward the front.

As illustrated in FIG. 9, the plurality of (specifically two in the embodiment) protruding portions 71 are provided between the two developing-cartridge grip portions 77. The protruding portions 71 are formed in a general plate shape that protrudes frontward from the front wall of the developing-cartridge frame 25. The protruding portions 71 are arranged to confront and be spaced apart from each other in the left-right direction.

(2-1) Power Supply Unit

As illustrated in FIG. 5, the power supply unit 75 includes a supply electrode 78, a bearing member 79, and a developing electrode 80.

The supply electrode 78 is formed of an electrically conductive resin material. The supply electrode 78 is supported with play on a right surface of the right developing-cartridge side wall 31. The supply electrode 78 includes a supply-electrode contact portion 81 that is electrically connected to a main-casing supply electrode (not illustrated) provided in the main casing 2. The supply electrode 78 is electrically connected to the supply roller shaft 46 although not illustrated in the drawings. The supply-electrode contact portion 81 extends in the left-right direction and has a general square cylindrical shape that is substantially rectangular in a side view and closed on a right end thereof.

The bearing member 79 is formed of an electrically insulating resin material. The bearing member 79 is fixed to the right developing-cartridge side wall 31 and disposed on a right side of the supply electrode 78. Moreover, the bearing member 79 includes an insulating portion 82. The insulating portion 82 is disposed on a rear side of the supply-electrode contact portion 81 and faces the supply-electrode contact portion 81. The bearing member 79 rotatably supports right end portions of the supply roller shaft 46 and the developing roller shaft 44 although not illustrated in the drawings. The insulating portion 82 extends in the left-right direction and has a general square cylindrical shape that is substantially L-shaped in a side view and closed on a right end thereof.

The developing electrode 80 is formed of an electrically conductive resin material. The developing electrode 80 is supported to the bearing member 79 with play and disposed on a right side of the bearing member 79. The developing electrode 80 includes a developing-electrode contact portion 83 and a developing-roller-shaft collar portion 84. The developing-electrode contact portion 83 is electrically connected to a main-casing developing electrode (not illustrated) provided in the main casing 2. The developing-roller-shaft collar portion 84 covers the right end portion of the developing roller shaft 44 from a radially outer side thereof.

The developing-electrode contact portion 83 is disposed diagonally below and rearward of the insulating portion 82 of the bearing member 79. With this arrangement, the supply-electrode contact portion 81 and the developing-electrode contact portion 83 are electrically isolated by the insulating portion 82. The developing-electrode contact portion 83 extends in the left-right direction and has a general square cylindrical shape that is substantially rectangular in a side view and closed on a right end thereof.

The developing-roller-shaft collar portion 84 is disposed diagonally below and rearward of the developing-electrode contact portion 83. The developing-roller-shaft collar portion 84 has a general cylindrical shape that extends in the left-right direction. The right end portion of the developing roller shaft 44 is rotatably inserted in the developing-roller-shaft collar portion 84.

(2-2) Drive Unit

As illustrated in FIGS. 3B and 4, the drive unit 76 includes a collar member 86, a gear train 87, and a gear cover 88.

As illustrated in FIG. 3B, the collar member 86 has a generally cylindrical shape that extends in the left-right direction and is closed on a left end thereof. The collar member 86 is fixed to the left developing-cartridge side wall 31 at its rear end portion. A left end portion of the developing roller shaft 44 is rotatably inserted in the collar member 86.

As illustrated in FIG. 4, the gear train 87 includes a developing-cartridge coupling 89 as an example of an input portion, a developing gear 90, a supply gear 100 (see FIG. 11), an idle gear 91, and a detected gear 92 as an example of a detected body. The gear train 87 further includes an agitator gear although not illustrated in the drawings. The agitator gear (not illustrated) is supported on a left end portion of the agitator shaft 42 so as to be incapable of rotating relative thereto, and engages with a small-diameter portion 95 (described later) of the idle gear 91 on a lower rear side thereof.

As illustrated in FIG. 3B, the developing-cartridge coupling 89 is disposed diagonally above and frontward of the collar member 86. The developing-cartridge coupling 89 has a generally columnar shape extending in the left-right direction. The developing-cartridge coupling 89 is rotatably supported on a left surface of the left developing-cartridge side wall 31. As illustrated in FIG. 4, the developing-cartridge coupling 89 has a right end portion at which a gear portion 93 is provided. The gear portion 93 has gear teeth on its entire circumference.

As illustrated in FIG. 3B, a coupling recess 94 is formed in a left endface of the developing-cartridge coupling 89. The coupling recess 94 is recessed rightward from the left endface of the developing-cartridge coupling 89.

As illustrated in FIG. 4, the developing gear 90 is supported on the left end portion of the developing roller shaft 44 so as to be incapable of rotating relative thereto, and engages with the gear portion 93 of the developing-cartridge coupling 89 on a lower rear side thereof.

Figure 11:
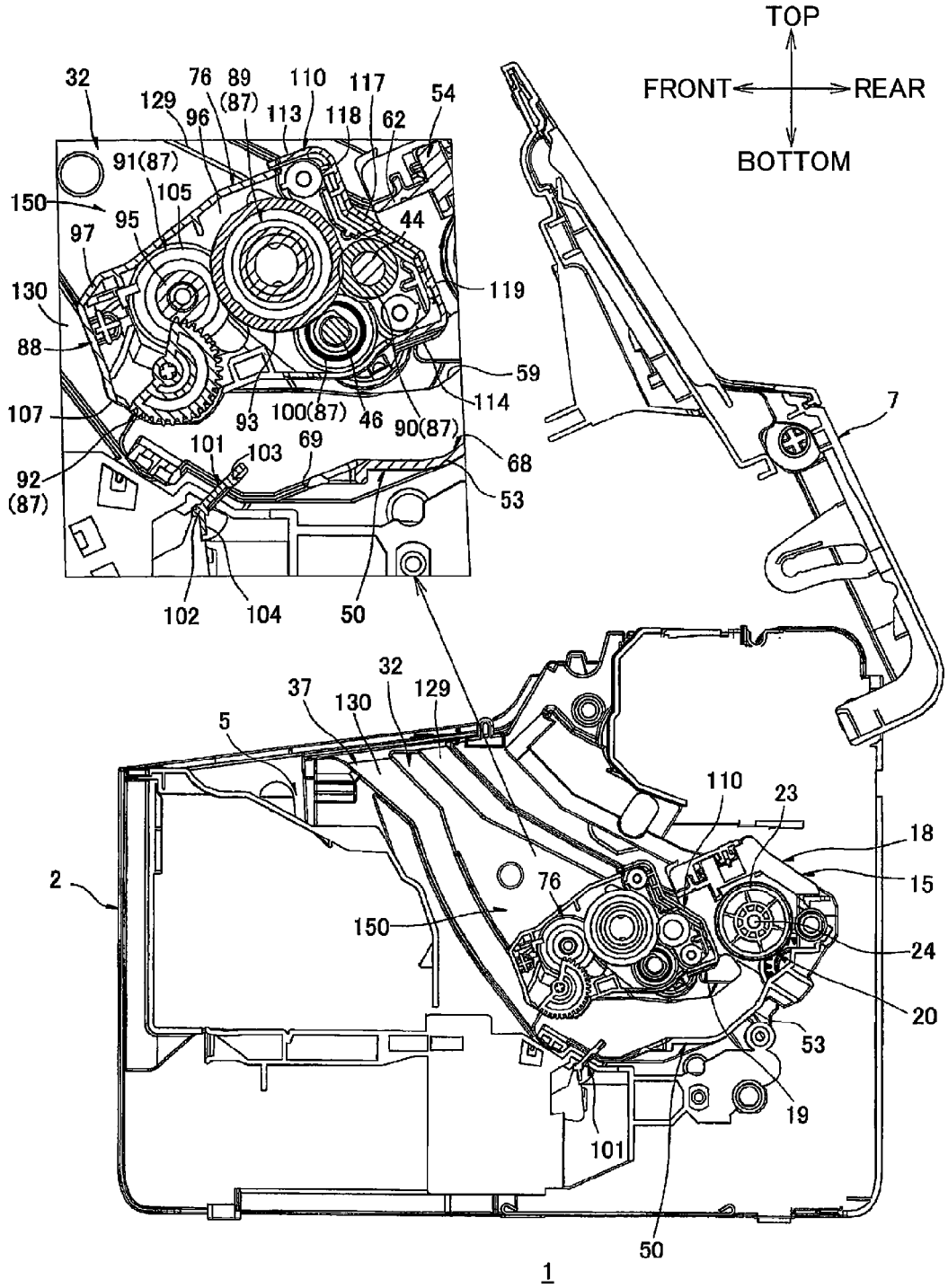
FIG. 11 is a cross-sectional view of the printer illustrated in FIG. 10 taken along a line A-A in FIG. 10.

As illustrated in FIG. 11, the supply gear 100 is supported on a left end portion of the supply roller shaft 46 so as to be incapable of rotating relative thereto, and engages with the gear portion 93 of the developing-cartridge coupling 89 on a bottom side thereof.

The idle gear 91 is rotatably supported in the left developing-cartridge side wall 31 and disposed on a front side of the developing-cartridge coupling 89. The idle gear 91 has a general cylindrical shape that extends in the left-right direction. The idle gear 91 integrally includes a large-diameter portion 105 and the small-diameter portion 95.

The large-diameter portion 105 constitutes a left end portion of the idle gear 91. The large-diameter portion 105 is formed in a general disc shape. Gear teeth are formed on a circumferential surface of the large-diameter portion 105 across its entire circumference. The large-diameter portion 105 engages with the gear portion 93 of the developing-cartridge coupling 89 on a front side thereof.

The small-diameter portion 95 extends rightward from a right surface of the large-diameter portion 105. The small-diameter portion 95 is formed in a general columnar shape. The small-diameter portion 95 has an outer diameter that is smaller than an outer diameter of the large-diameter portion 105. Moreover, the small-diameter portion 95 shares a common central axis with the large-diameter portion 105. Gear teeth are formed on a circumferential surface of the small-diameter portion 95 across its entire circumference.

As illustrated in FIG. 4, the detected gear 92 is disposed diagonally below and frontward of the developing-cartridge coupling 89. The detected gear 92 is formed in a general plate shape that is substantially semi-circular shape in a side view. The detected gear 92 is rotatably supported in the left developing-cartridge side wall 31 on a radially center portion thereof. Gear teeth are formed on a circumferential surface of the detected gear 92. The detected gear 92 has a downstream circumferential end portion in a clockwise direction in a left side view that engages with the small-diameter portion 95 of the idle gear 91 on a lower front side thereof.

As illustrated in FIGS. 3B and 4, the gear cover 88 is formed in approximately the same shape and size in a side view as those of the left developing-cartridge side wall 31. The gear cover 88 integrally includes a cover plate 96 and a circumferential side wall 97. The cover plate 96 is generally plate-shaped and covers the gear train 87 from a left side thereof. The circumferential side wall 97 protrudes rightward from a circumferential edge of the cover plate 96. That is, the gear cover 88 has a generally U-shape both in a cross-sectional view taken along a plane orthogonal to the vertical direction and in a cross-sectional view taken along a plane orthogonal to the front-rear direction, with an opening of the "U" facing rightward.

As illustrated in FIG. 3B, the cover plate 96 has a collar insertion hole 98 and a coupling insertion hole 99. The collar insertion hole 98 is formed in a rear end portion of the cover plate 96 and penetrates the cover plate 96 in the left-right direction. The collar member 86 is inserted into the collar insertion hole 98. The coupling insertion hole 99 is formed in the cover plate 96 at a position slightly rearward of an approximately center portion of the cover plate 96 and penetrates the cover plate 96 in the left-right direction. The developing-cartridge coupling 89 is inserted into the coupling insertion hole 99.

As illustrated in FIG. 4, an exposing hole 107 is formed in a lower-front end portion of the circumferential side wall 97 and penetrates the circumferential side wall 97 in a direction from the upper rear to the lower front. The detected gear 92 is exposed outside the gear cover 88 on a lower-front side thereof through the exposing hole 107.

The gear cover 88 is attached to the left developing-cartridge side wall 31 from a left side thereof and covers the gear train 87. With this arrangement, as illustrated in FIG. 3B, the collar member 86 is inserted into the collar insertion hole 98 of the cover plate 96 and protrudes outward in the left-right direction from the cover plate 96. Moreover, the coupling recess 94 of the developing-cartridge coupling 89 is exposed outside the cover plate 96 in the left-right direction through the coupling insertion hole 99.

(3) Roller Cover

The developing cartridge 19 having a configuration described above is replaced by a user when its service life ends, for example, when the amount of toner in the toner-accommodating chamber 26 is smaller than a predetermined amount.

For this reason, the developing cartridge 19 alone may be shipped and transported.

In such a case, as illustrated in FIG. 5, a roller cover 110 as an example of a protection cover is attached to a rear end portion of the developing-cartridge frame 25 of the developing cartridge 19. In this way, the developing roller 34 exposed outside the developing-cartridge frame 25 through the opening 30 can be protected by the roller cover 110.

The roller cover 110 is formed of a polymer material such as a resin material, more specifically, polypropylene. The roller cover 110 has a general box shape that is open on a front side thereof. That is, the roller cover 110 has a substantially U-shape in a cross-sectional view taken along a plane orthogonal to the left-right direction (see FIG. 11, for example).

As illustrated in FIG. 5, the roller cover 110 integrally has a pair of left and right cover side walls 111, a cover top wall 113, a cover bottom wall 114, and a cover body portion 112.

The pair of cover side walls 111 has a general rectangular shape in a side view that extends in the vertical direction. The pair of cover side walls 111 are arranged to face and be spaced apart from each other in the left-right direction.

Each of the pair of cover side walls 111 has a collar insertion groove 115. The collar insertion groove 115 is formed in a general U-shape in a side view, recessed rearward from a front edge of the cover side wall 111 on an approximate vertical center portion thereof.

In a state where the roller cover 110 is attached to the developing cartridge 19, the developing-roller-shaft collar portion 84 is received in the collar insertion groove 115 of the right cover side wall 111 as illustrated in FIG. 5, while the collar member 86 is received in the collar insertion groove 115 of the left cover side wall 111 as illustrated in FIG. 8.

As illustrated in FIG. 5, the cover top wall 113 bridges top edges of the pair of cover side walls 111, and the cover bottom wall 114 bridges bottom edges of the pair of cover side walls 111.

The cover body portion 112 bridges rear edges of the pair of cover side walls 111. The cover body portion 112 integrally includes an upper plate portion 118, a lower plate portion 119, a pair of cover side portions 117 as an example of a pair of releasing portions, and a roller facing portion 116.

The upper plate portion 118 constitutes an upper end portion of the cover body portion 112. The upper plate portion 118 protrudes downward continuously from a rear edge of the cover top wall 113. The upper plate portion 118 is formed in a general plate shape that extends in the left-right direction.

The lower plate portion 119 constitutes a lower end portion of the cover body portion 112. The lower plate portion 119 protrudes upward continuously from a rear edge of the cover bottom wall 114. The lower plate portion 119 is formed in a general plate shape that extends in the left-right direction.

Each of the pair of cover side portions 117 is provided so as to connect a left-right end portion of the upper plate portion 118 and a left-right end portion of the lower plate portion 119 in the vertical direction. In other words, the cover side portions 117 are respectively provided at left and right end portions of the cover body portion 112. Specifically, each of the pair of cover side portions 117 has a general plate shape that extends continuously from a top edge of the lower plate portion 119 at a left-right end portion thereof and is inclined forward toward the top. Moreover, each of the pair of cover side portions 117 has an outer left-right end that is connected to a rear edge of the cover side wall 111.

The roller facing portion 116 bridges inner left-right ends of the pair of cover side portions 117. The roller facing portion 116 is formed in a general arcuate shape in a side view, with its convex side facing rearward, which conforms to a circumferential surface of the rubber roller body 45.

Figure 12:
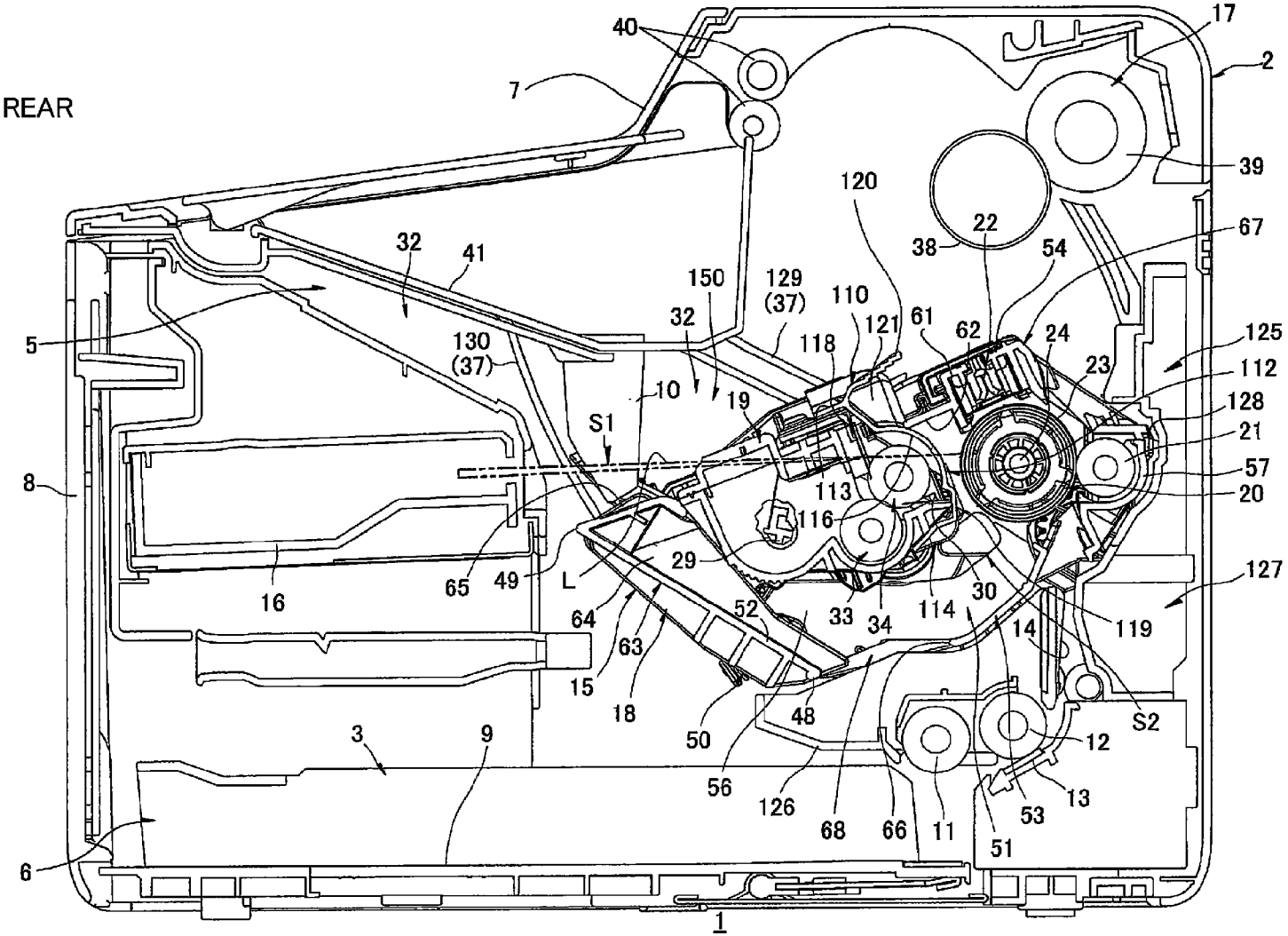
FIG. 12 is a central cross-sectional view of the printer in which the process cartridge provided with the roller cover illustrated in FIG. 6 is accommodated in a main casing of the printer.

In a state where the roller cover 110 is attached to the developing cartridge 19, the roller facing portion 116 faces the circumferential surface of the rubber roller body 45 with a gap therebetween, as illustrated in FIG. 12.

As illustrated in FIG. 5, the roller cover 110 further integrally includes a cover handle portion 120 and a pair of rib abutting portions 121 as an example of a projection.

The cover handle portion 120 has a general plate shape that is substantially rectangular in a plan view, protruding diagonally above and rearward from a continuous portion between the upper plate portion 118 and the cover top wall 113 on an approximate left-right center region thereof.

The pair of rib abutting portions 121 is provided one on each of left and right sides of the cover handle portion 120 with a gap therebetween. Each of the pair of rib abutting portions 121 is formed so as to protrude diagonally above and rearward from a region across the roller facing portion 116, the upper plate portion 118, and the cover top wall 113. Each of the pair of rib abutting portions 121 has an upper surface that is formed in parallel to an upper surface of the cover top wall 113, and a rear surface that is formed in parallel to a rear surface of the lower plate portion 119.

3. Detailed Description of Main Casing (1) Process-Cartridge Mounting Portion

As illustrated in FIG. 10, the main casing 2 has a pair of main-casing side walls 32 and a process-cartridge mounting portion 125. The pair of main-casing side walls 32 is arranged to face and be spaced apart from each other in the left-right direction. The process-cartridge mounting portion 125 is disposed between the pair of main-casing side walls 32 as illustrated in FIG. 1. The scanning unit 16 is also disposed between the pair of main-casing side walls 32.

The process-cartridge mounting portion 125 is configured to support the process cartridge 15 at its mounted position, which will be described later. The process-cartridge mounting portion 125 is disposed in a rear portion of the main casing 2. With respect to the vertical direction, the process-cartridge mounting portion 125 is disposed between the sheet supply unit 3 and the fixing unit 17.

The process-cartridge mounting portion 125 extends in the left-right direction and is formed in a general L-shape in a side view. The process-cartridge mounting portion 125 includes a first mounting portion 126 constituting a front portion thereof and a second mounting portion 127 constituting a rear portion thereof.

The first mounting portion 126 has a generally rectangular shape in a side view that extends in the front-rear direction. The first mounting portion 126 has a lower end portion at which the pickup roller 11 and the feeding roller 12 are rotatably supported. Moreover, the first mounting portion 126 has an upper surface having a shape that conforms to a lower end portion of the process cartridge 15, more specifically, a lower surface of a portion of the drum bottom wall 53 corresponding to the cartridge-mounting portion 68.

The second mounting portion 127 has a general rectangular shape in a side view that extends in the vertical direction. The second mounting portion 127 has an engagement groove 128. The engagement groove 128 is formed in a front surface of the second mounting portion 127 on an approximate vertical center region thereof.

The engagement groove 128 is formed in a general curved shape in a side view, recessed rearward from the front surface of the second mounting portion 127. The engagement groove 128 has a shape that conforms to a rear end portion of the process cartridge 15, more specifically, an outer surface of the drum rear wall 57.

The second mounting portion 127 is disposed rearward of the first mounting portion 126 such that a portion of the front surface of the second mounting portion 127 positioned lower than the engagement groove 128 faces a rear surface of the first mounting portion 126 in the front-rear direction with a gap therebetween. Moreover, the feeding path 14 is formed by the rear surface of the first mounting portion 126 and the portion of the front surface of the second mounting portion 127 positioned lower than the engagement groove 128.

(2) Scanning Unit

The scanning unit 16 is disposed in a front portion of the main casing 2. More specifically, the scanning unit 16 is disposed frontward of the second mounting portion 127. The scanning unit 16 confronts but is spaced apart from the second mounting portion 127 in the front-rear direction.

The main casing 2 has a cartridge-accommodating portion 150 as an example of a cartridge accommodating portion that is defined by the process-cartridge mounting portion 125, the scanning unit 16, and the pair of main-casing side walls 32. The laser beam L irradiated from the scanning unit 16 passes through the cartridge-accommodating portion 150. That is, the cartridge-accommodating portion 150 includes an exposure space S1.

(3) Guide Portion

As illustrated in FIGS. 1, 3A, 3B, and 11, the main casing 2 includes guide portions 37, an actuator 101 as an example of a detector, and a main-casing coupling 133 as an example of a transmitting portion.

As illustrated in FIG. 1, the guide portions 37 are respectively provided on inner surfaces of the main-casing side walls 32 at a position corresponding to the cartridge-accommodating portion 150 and face each other.

Each of the guide portions 37 includes a drum-shaft guide portion 129 and a boss guide portion 130.

The drum-shaft guide portion 129 is provided so as to be inclined downward toward the rear from an approximately front-rear center region on a top edge of the main-casing side wall 32. The drum-shaft guide portion 129 is recessed outward in the left-right direction from the inner left-right surface of the main-casing side wall 32.

The boss guide portion 130 is provided on a front side of and spaced apart from the drum-shaft guide portion 129. The boss guide portion 130 is recessed outward in the left-right direction from the inner left-right surface of the main-casing side wall 32. Moreover, the boss guide portion 130 is inclined rearward toward the bottom from the top edge of the main-casing side wall 32. The boss guide portion 130 has a downward inclination larger than that of the drum-shaft guide portion 129. That is, the drum-shaft guide portion 129 and the boss guide portion 130 are provided such that a front-rear gap between the drum-shaft guide portion 129 and the boss guide portion 130 increases toward a lower-rear side thereof.

(4) Actuator and Main-Casing Coupling

As illustrated in FIG. 11, the actuator 101 is provided at a left end portion of the main casing 2 in an approximate front-rear center region thereof. The actuator 101 is arranged to face, in the vertical direction, the detected gear exposure opening 69 of the process cartridge 15 when the process cartridge 15 is disposed at the mounted position (described later).

As illustrated in FIGS. 4 and 11, the actuator 101 includes a pivot shaft 102, a detecting portion 103, and an acting portion 104. In the following description of the actuator 101, it is assumed that the actuator 101 is placed in a non-detection position (described later).

The pivot shaft 102 is formed in a general columnar shape that extends in the left-right direction. The detecting portion 103 is formed in a general rod shape that extends diagonally upward and rearward continuously from an upper rear end of the pivot shaft 102. The acting portion 104 is formed in a general rod shape that extends downward continuously from a lower end of the pivot shaft 102.

The pivot shaft 102 is rotatably supported on the left main-casing side wall 32, whereby the actuator 101 is supported in the main casing 2 so as to be capable of pivotally moving about the pivot shaft 102. With this configuration, the actuator 101 can pivotally move between a non-detection position in which the detecting portion 103 erects diagonally upward and rearward as illustrated in FIG. 11 and a detection position in which the detecting portion 103 is tilted rearward as illustrated in FIG. 4. The actuator 101 is normally biased toward the non-detection position by a biasing member (not illustrated).

As illustrated in FIG. 11, when the actuator 101 is placed in the non-detection position, the acting portion 104 is not detected by a sensor (not illustrated), such as an optical sensor, provided in the main casing 2. On the other hand, as illustrated in FIG. 4, when the actuator 101 is placed in the detection position, the acting portion 104 is detected by the sensor (not illustrated) provided in the main casing 2.

As illustrated in FIG. 3B, the main-casing coupling 133 is provided on the left main-casing side wall 32. The main-casing coupling 133 is formed in a general columnar shape that extends in the left-right direction and is configured to advance and retract in the left-right direction in conjunction with a movement of the top cover 7. Moreover, the main-casing coupling 133 has a right end portion that is fitted with the coupling recess 94 of the developing-cartridge coupling 89 so as to be immovable relative thereto when the main-casing coupling 133 advances rightward.

4. Operation for Packaging Printer

When such a printer 1 is shipped and transported, for example, rather than packaging the process cartridge 15 and the main casing 2 separately, the printer 1 is packaged in a state where the process cartridge 15 with the roller cover 110 is accommodated in the main casing 2 as illustrated in FIG. 12.

(1) Operation for Accommodating Developing Cartridge in Drum Cartridge

Figure 6:
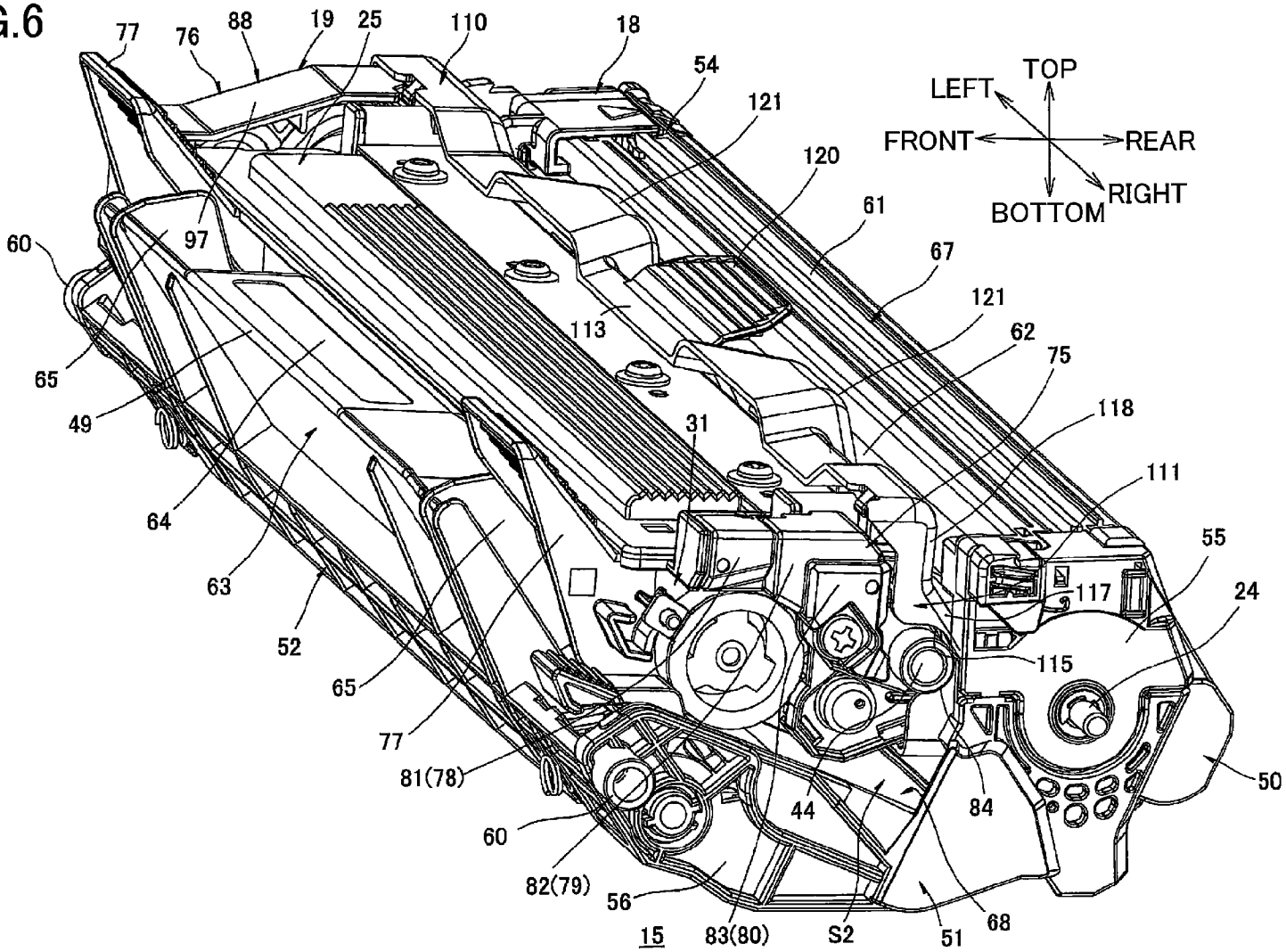
FIG. 6 is a perspective view of a process cartridge provided with the roller cover according to the first embodiment as viewed from its upper-right side.

More specifically, in order to package the printer 1, as illustrated in FIGS. 5 and 6, first, the developing cartridge 19 to which the roller cover 110 is attached is accommodated in the cartridge-mounting portion 68 of the drum cartridge 18.

In order to accommodate the developing cartridge 19 to which the roller cover 110 is attached in the cartridge-mounting portion 68, a user inserts the developing cartridge 19 to which the roller cover 110 is attached into the mounting space S2 defined between the drum-accommodating portion 67 and the extension portion 63 from a top side thereof.

Through this operation, as illustrated in FIG. 12, the pair of rib abutting portions 121 of the roller cover 110 comes into contact with the rib 62 of the drum-accommodating portion 67, and the front end portion of the developing-cartridge frame 25 comes into contact with the handle portion 64 of the extension portion 63.

When the user continues to move the developing cartridge 19 to which the roller cover 110 is attached further downward, the extension portion 63 and the drum front wall 52 are resiliently deformed rearward. As a result, the developing cartridge 19 to which the roller cover 110 is attached is interposed between the rib 62 of the drum-accommodating portion 67 and the handle portion 64 of the extension portion 63, thereby being resiliently supported in the cartridge-mounting portion 68.

In this way, the developing cartridge 19 to which the roller cover 110 is attached is placed in an accommodated position. In the accommodated position, the developing cartridge 19 to which the roller cover 110 is attached is accommodated in the mounting space S2 of the cartridge-mounting portion 68. As a result, the process cartridge 15 having the roller cover 110 is configured. The process cartridge 15 and the roller cover 110 constitute an example of a cartridge.

At this time, the extension portion 63 is positioned opposite to the drum-accommodating portion 67 with respect to the developing cartridge 19 placed in the accommodated position. Further, a portion of the drum bottom wall 53 corresponding to the cartridge-mounting portion 68 is disposed downward of the developing cartridge 19 placed in the accommodated position and faces the developing cartridge 19 with a gap therebetween.

Further, as illustrated in FIG. 6, the pair of cover side portions 117 of the roller cover 110 is disposed downward of the rib 62 of the drum top wall 54 and faces the rib 62 with a gap therebetween. Moreover, as illustrated in FIG. 12, the cover body portion 112 and the lower plate portion 119 of the roller cover 110 are disposed to face the photosensitive drum 20 with a gap therebetween. That is, the roller cover 110 is separated from the photosensitive drum 20 when the process cartridge 15 with the roller cover 110 is at the accommodated position.

Further, as illustrated in FIG. 9, the developing-cartridge grip portions 77 of the developing cartridge 19 are respectively disposed on outer left and right sides of the pressure-receiving portions 65 of the extension portion 63 such that the extension portion 63 is interposed between the developing-cartridge grip portions 77. More specifically, the developing-cartridge grip portions 77 respectively face the pressure-receiving portions 65 in the left-right direction with a gap therebetween. Moreover, each of the protruding portions 71 of the developing cartridge 19 is disposed between each of the pressure-receiving portions 65 and the handle portion 64 in the left-right direction. More specifically, the protruding portions 71 are respectively disposed on outer left and right sides of the handle portion 64, facing the handle portion 64 with a gap therebetween, and respectively disposed on inner left and right sides of the pressure-receiving portions 65, facing the pressure-receiving portions 65 with a gap therebetween.

(2) Operation for Accommodating Process Cartridge Provided with Protection Cover in Main Casing Next, the process cartridge 15 with the roller cover 110 is accommodated in the cartridge-accommodating portion 150 of the main casing 2.

In order to accommodate the process cartridge 15 with the roller cover 110 in the cartridge-accommodating portion 150 of the main casing 2, first, the user places the top cover 7 of the main casing 2 in the open position to open the cartridge access opening 5 as illustrated in FIG. 10.

Subsequently, as illustrated in FIGS. 1 and 6, the user grips the handle portion 64 of the drum cartridge 18 to insert the process cartridge 15 into the main casing 2 through the cartridge access opening 5 such that the left and right end portions of the drum shaft 24 are fitted in the drum-shaft guide portions 129 from an upper-front side thereof and that the guide bosses 60 are fitted in the boss guide portions 130 from an upper-front side thereof. Thereafter, the user pushes the process cartridge 15 downward and rearward.

Then, the left and right end portions of the drum shaft 24 are guided by the drum-shaft guide portions 129, and the guide bosses 60 are guided by the boss guide portions 130. Hence, the process cartridge 15 is moved diagonally downward and rearward while rotating in a counter-clockwise direction in a right side view about the drum shaft 24 of the photosensitive drum 20.

When the left and right end portions of the drum shaft 24 reach bottom ends of the drum-shaft guide portion 129 and the guide bosses 60 reach bottom ends of the boss guide portions 130, the drum rear wall 57 of the drum frame 50 is fitted in the engagement groove 128 of the second mounting portion 127 and the drum bottom wall 53 of the drum frame 50 is disposed above the first mounting portion 126.

In this way, the process cartridge 15 with the roller cover 110 is placed in the mounted position to be mounted in the process-cartridge mounting portion 125, and is accommodated in the cartridge-accommodating portion 150. That is, the process cartridge 15 is accommodated in the cartridge-accommodating portion 150 in a state where the developing cartridge 19 is disposed at the accommodated position.

At this time, the developing cartridge 19 at the accommodated position is disposed in the main casing 2 so as to overlap the irradiation path of the laser beam L irradiated from the scanning unit 16. That is, in a state where the process cartridge 15 is accommodated in the cartridge-accommodating portion 150, at least a portion of the developing cartridge 19 at the accommodated position is disposed in the exposure space S1 that allows the laser beam L to pass therethrough.

Further, as illustrated in FIG. 11, the detected gear 92 is disposed above the actuator 101 so as not to contact the actuator 101. That is, the actuator 101 continues to be placed in the non-detection position.

Figure 7A:
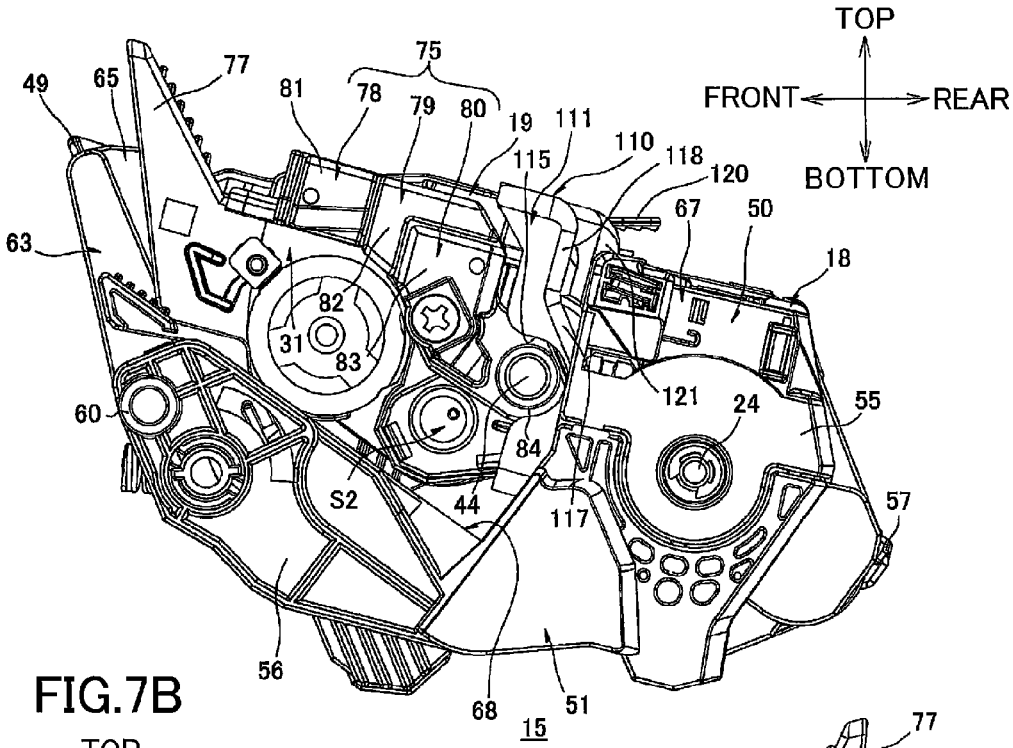
Figure 7B:
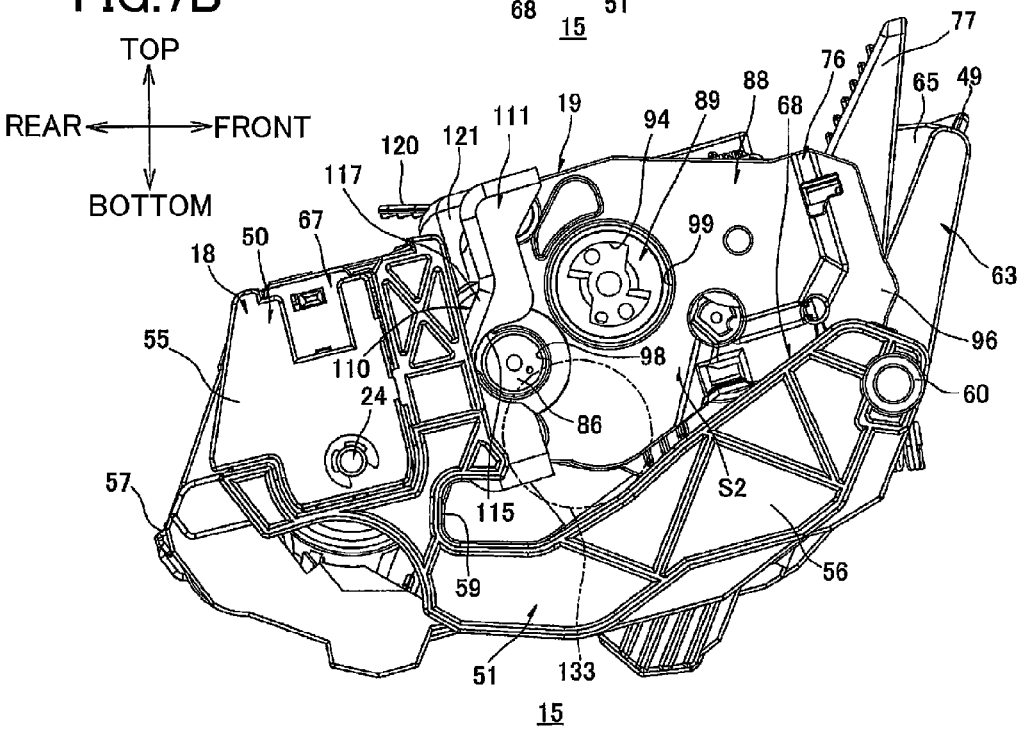

Further, as illustrated in FIG. 7B, the developing-cartridge coupling 89 does not oppose the main-casing coupling 133 in the left-right direction and is disposed above and forward of the main-casing coupling 133. That is, even when the top cover 7 is placed in the closed position and the main-casing coupling 133 advances rightward, the coupling recess 94 of the developing-cartridge coupling 89 does not engage with the main-casing coupling 133.

Subsequently, the user moves the top cover 7 of the main casing 2 from the open position toward the closed position.

Figure 13:
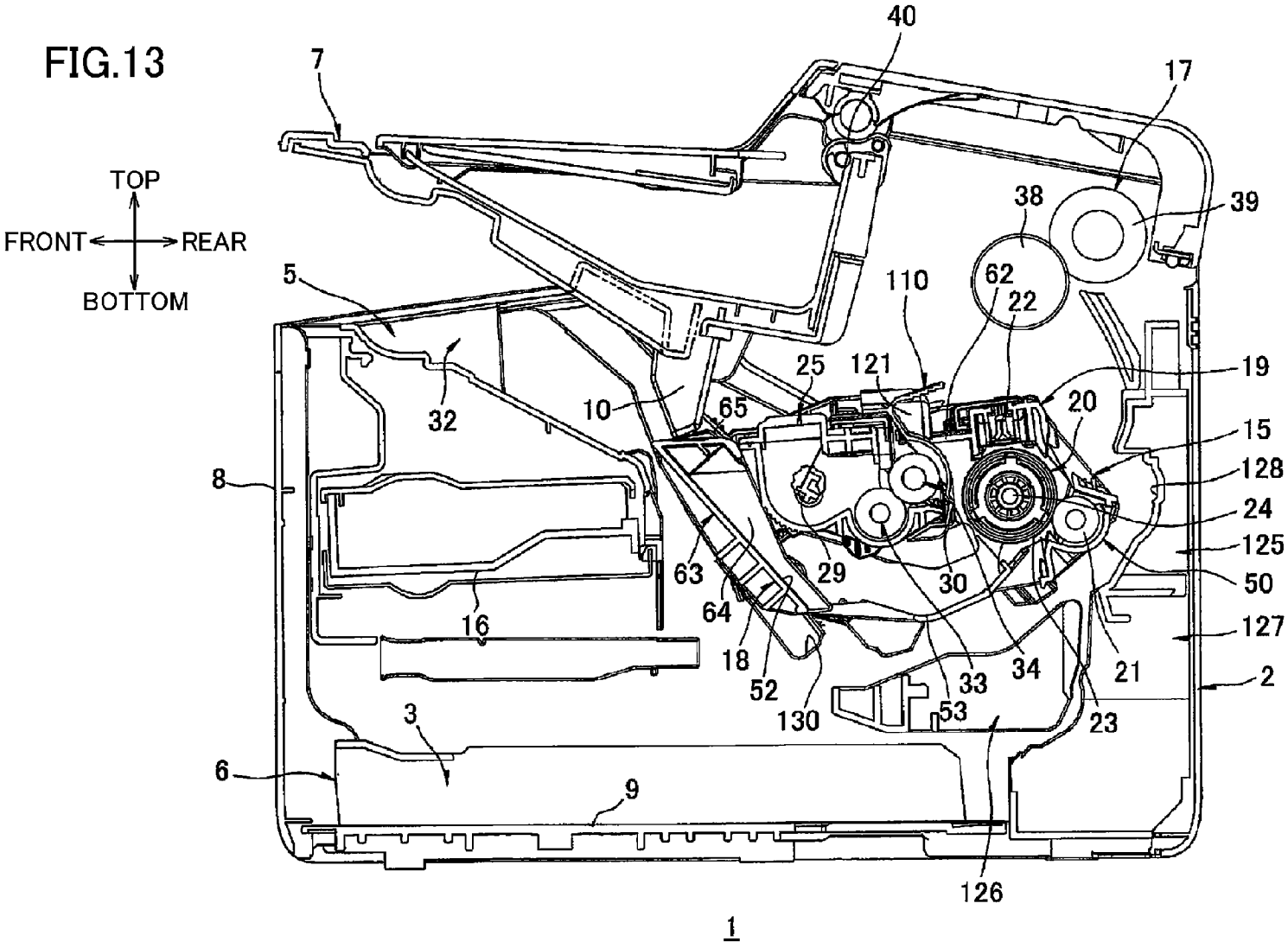
FIG. 13 is an explanatory diagram for describing how pressing portions provided at a top cover illustrated in FIG. 12 presses the process cartridge.

At this time, as illustrated in FIG. 13, if the process cartridge 15 with the roller cover 110 has not been sufficiently mounted in the process-cartridge mounting portion 125, the pressing portions 10 will abut against top edges of the pressure-receiving portions 65 of the extension portion 63 from a top side thereof.

As the top cover 7 continues to move to the closed position, the drum cartridge 18 is pressed downward by the pressing portions 10 through the pressure-receiving portions 65. This pressure will place the process cartridge 15 with the roller cover 110 in the proper mounted position inside the main casing 2 as illustrated in FIG. 12.

In this way, the top cover 7 is placed in the closed position while the process cartridge 15, in which the developing cartridge 19 is placed in the accommodated position, is accommodated in the cartridge-accommodating portion 150.

(3) Packaging of Printer

The printer 1 in which the process cartridge 15 with the roller cover 110 is accommodated in the cartridge-accommodating portion 150 is packaged in a box-shaped packaging material (not illustrated), for example, and is shipped and transported.

5. Installation of Printer

When the packaged printer 1 is made available for use, first, the user takes out the printer 1 from the package (not illustrated) and places the printer 1 on a level surface for installation.

(1) Operation for Removing Process Cartridge with Protection Cover from Main Casing Next, the user removes the process cartridge 15 with the roller cover 110 from the main casing 2.

In order to remove the process cartridge 15 with the roller cover 110 from the main casing 2, steps in the operation for accommodating the process cartridge 15 with the roller cover 110 in the main casing 2 described above are performed in reverse.

Specifically, as illustrated in FIG. 10, the user places the top cover 7 of the main casing 2 in the open position, grips the handle portion 64 of the drum cartridge 18, and pulls the handle portion 64 upward and frontward.

Then, as illustrated in FIG. 12, the left and right end portions of the drum shaft 24 are guided by the drum-shaft guide portions 129 and the guide bosses 60 are guided by the boss guide portions 130. Hence, the process cartridge 15 is moved diagonally upward and frontward while rotating in a clockwise direction in a right side view about the drum shaft 24 of the photosensitive drum 20.

As the user continues to pull the process cartridge 15 with the roller cover 110 upward and frontward, the process cartridge 15 is removed from the main casing 2 through the cartridge access opening 5.

This completes the operation for removing the process cartridge 15 with the roller cover 110 from the main casing 2.

(2) Operation for Detaching Protection Cover from Developing Cartridge and Operation for Mounting Developing Cartridge in Drum Cartridge Next, as illustrated in FIG. 6, the developing cartridge 19 at the accommodated position is removed from the cartridge-mounting portion 68 of the drum cartridge 18.

In order to remove the developing cartridge 19 disposed at the accommodated position from the cartridge-mounting portion 68 of the drum cartridge 18, the user grips the developing-cartridge grip portions 77 of the developing cartridge 19 to pull the developing-cartridge grip portions 77 upward. The developing cartridge 19 is thus removed upward from a position between the extension portion 63 and the drum-accommodating portion 67.

As a result, as illustrated in FIG. 5, the developing cartridge 19 to which the roller cover 110 is attached is removed from the drum cartridge 18.

Subsequently, the user grips the cover handle portion 120 of the roller cover 110 to pull the cover handle portion 120 upward and rearward, thereby detaching the roller cover 110 from the developing cartridge 19.

Subsequently, the user grips the developing-cartridge grip portions 77 of the developing cartridge 19 from which the roller cover 110 is detached, and inserts the developing cartridge 19 into the cartridge-mounting portion 68 of the drum cartridge 18 from a top side thereof, as illustrated in FIG. 2.

At this time, as illustrated in FIGS. 3A and 3B, the developing-roller-shaft collar portion 84 and the collar member 86 of the developing cartridge 19 are guided by top edges of the corresponding mounting-portion side walls 56 to be moved downward and rearward. In this way, the rear end portion of the developing cartridge 19 is moved downward and rearward.

Through this operation, the developing-roller-shaft collar portion 84 and the collar member 86 reach the corresponding collar-receiving grooves 59, and are moved rearward while guided by the corresponding collar-receiving grooves 59. As a result, the developing-roller-shaft collar portion 84 and the collar member 86 are fitted into the corresponding collar-receiving grooves 59, and the developing cartridge 19 is mounted in the cartridge-mounting portion 68 of the drum cartridge 18. That is, the developing roller 19 from which the roller cover 110 is detached is placed in a mounted position. Further, the collar-receiving grooves 59 guide mounting and removal of the developing cartridge 19 from which the roller cover 110 is detached in and from the cartridge-mounting portion 68.

This completes the operation for mounting the developing cartridge 19 in the cartridge-mounting portion 68.

At this time, as illustrated in FIG. 1, the developing roller 34 of the developing cartridge 19 is in contact with the photosensitive drum 20.

(3) Operation for Mounting of Process Cartridge in Main Casing

Next, the process cartridge 15 in which the developing cartridge 19 is mounted is mounted in the process-cartridge mounting portion 125 of the main casing 2.

In order to mount the process cartridge 15, in which the developing cartridge 19 is mounted, in the process-cartridge mounting portion 125 of the main casing 2, steps the same as those in the operation for accommodating the process cartridge 15 with the roller cover 110 in the main casing are performed.

Through this operation, the process cartridge 15 is mounted in its mounted position to be mounted in the process-cartridge mounting portion 125, and is also accommodated in the cartridge-accommodating portion 150.

At this time, the developing cartridge 19 is disposed below and spaced apart from the irradiation path of the laser beam L irradiated from the scanning unit 16.

Further, as illustrated in FIG. 4, the detected gear 92 is in contact with the actuator 101 from a lower-front side thereof through the detected gear exposure opening 69 and the exposing hole 107. The actuator 101 is thus placed in the detection position while resisting against the biasing force of the biasing member (not illustrated). As a result, a controller (not illustrated) provided in the main casing 2 determines that the developing cartridge 19 is mounted when a sensor (not illustrated) detects that the actuator 101 is placed in the detection position.

Further, as illustrated in FIG. 3B, the developing-cartridge coupling 89 faces the main-casing coupling 133 in the left-right direction with a gap therebetween.

Subsequently, the user moves the top cover 7 of the main casing 2 from the open position toward the closed position to place the top cover 7 in the closed position. This completes the operation for mounting the process cartridge 15, in which the developing cartridge 19 is mounted, in the process-cartridge mounting portion 125 of the main casing 2.

(4) Operation for Driving Developing Roller and Operation for Detecting New Cartridge When the user places the top cover 7 of the main casing 2 in the closed position, the main-casing coupling 133 (indicated by a chain double-dashed line in FIG. 3B) advances rightward in conjunction with the closing movement of the top cover 7 and is fitted with the developing-cartridge coupling 89 of the developing cartridge 19 so as to be incapable of rotating relative thereto.

Thereafter, a drive source (not illustrated) provided in the main casing 2 inputs a driving force in the clockwise direction in a left side view into the developing-cartridge coupling 89 through the main-casing coupling 133.

Then, as illustrated in FIG. 4, the driving force from the drive source (not illustrated) is transmitted to the developing gear 90 through the gear portion 93 of the developing-cartridge coupling 89 to be inputted into the developing roller shaft 44. As a result, the developing roller 34 is driven and rotates in the clockwise direction in a right side view, as illustrated in FIG. 1.

Further, as illustrated in FIG. 4, the driving force is transmitted to the detected gear 92 through the gear train 87 to rotate the detected gear 92 in the clockwise direction in a left side view.

As the detected gear 92 rotates, contact between the upstream circumferential end portion of the detected gear 92 in the clockwise direction in a left side view and the detecting portion 103 of the actuator 101 is released. The actuator 101 is thus pivotally moved in the clockwise direction in a left side view by the biasing force of the biasing member (not illustrated), and is placed in the non-detection position.

As the detected gear 92 continues to rotate in the clockwise direction in a left side view, the downstream circumferential end portion of the detected gear 92 in the clockwise direction in a left side view abuts against the detecting portion 103 of the actuator 101 from a top side thereof. As a result, the actuator 101 is pivotally moved in a counter-clockwise direction in a left side view while resisting against the biasing force of the biasing member (not illustrated). Thus, the actuator 101 is placed in the detection position.

As the detected gear 92 further continues to rotate in the clockwise direction in a left side view, the upstream circumferential end portion of the detected gear 92 in the clockwise direction in a left side view is disengaged from the small-diameter portion 95 of the idle gear 91. At this time, the downstream circumferential end portion of the detected gear 92 in the clockwise direction in a left side view remains abutted with the detecting portion 103 of the actuator 101 from a top side thereof.

The controller (not illustrated) determines that the developing cartridge 19 is not used (i.e. the developing cartridge 19 is new) when the sensor (not illustrated) detects that the actuator 101 has been moved from the detection position to the non-detection position, and then from the non-detection position to the detection position.

Further, when the developing cartridge 19 under usage is mounted in the main casing 2, the detected gear 92 does not engage with the idle gear 91. Hence, the detected gear 92 does not rotate and the downstream circumferential end portion of the detected gear 92 in the clockwise direction in a left side view continues to abut against the detecting portion 103 of the actuator 101 from a top side thereof. Thus, the actuator 101 continues to be placed in the detection position. In this case, the controller (not illustrated) determines that the developing cartridge 19 is not new when the sensor (not illustrated) detects that the actuator 101 continues to be placed in the detection position for a predetermined period of time.

6. Operational Advantages (1) In the process cartridge 15, as illustrated in FIG. 6, the developing cartridge 19 to which the roller cover 110 is attached can be disposed at the accommodated position to be accommodated in the cartridge-mounting portion 68. With this arrangement, in a state where the developing cartridge 19 is disposed at the accommodated position, the developing roller 34 can be separated from the photosensitive drum 20 while being protected by the roller cover 110.

That is, the roller cover 110, which is attached to the developing cartridge 19 when the developing cartridge 19 alone is transported, can be used as a member for separating the developing roller 34 from the photosensitive drum 20 when the developing cartridge 19 is at the accommodated position.

The printer 1 is thus shipped and transported while accommodating the process cartridge 15, in which the developing cartridge 19 is disposed at the accommodated position, in the cartridge-accommodating portion 150 of the main casing 2, as illustrated in FIG. 12. As a result, the package of the printer 1 for transportation can be reduced in size and permanent deformation of the developing roller 34 can also be suppressed.

The roller cover 110 can be used as a member for separating the developing roller 34 from the photosensitive drum 20 during transportation of the printer 1 in which the process cartridge 15 is accommodated in the cartridge-accommodating portion 150. Therefore, as compared to a case where a separate member to be used only during transportation of the printer 1 is provided, the transportation cost of the process cartridge 15 can be reduced, which in turn enables the transportation cost of the printer 1 to be reduced.

(2) Further, the developing cartridge 19 is resiliently supported in the drum cartridge 18 when the developing cartridge 19 is at the accommodated position, as illustrated in FIG. 6.

With this arrangement, even if the developing cartridge 19 interferes with a member provided in the main casing 2 such as the pressing portions 10 of the top cover 7 when the printer 1 is being transported, impact resulting from the interference can be absorbed.

As a result, during transportation of the printer 1 in which the process cartridge 15 is accommodated in the main casing 2, damages to the drum cartridge 18 and to the developing cartridge 19 can be suppressed.

(3) Further, the developing cartridge 19 at the accommodated position is resiliently supported in the drum cartridge 18 while being interposed between the drum-accommodating portion 67 and the extension portion 63, as illustrated in FIG. 6.

With this arrangement, the developing cartridge 19 at the accommodated position can be reliably resiliently supported in the drum cartridge 18 with a simple structure.

(4) Further, the opening 66 is formed in the drum bottom wall 53 at the continuous portion 36 connected to the drum front wall 52 as illustrated in FIG. 8.

Therefore, the drum front wall 52 and the extension portion 63 can be reliably configured to be resiliently deformable.

As a result, as illustrated in FIG. 6, the developing cartridge 19 that is disposed at the accommodated position and interposed between the drum-accommodating portion 67 and the extension portion 63 can be more reliably resiliently supported in the drum cartridge 18.

(5) Further, the drum front wall 52 and the extension portion 63 are inclined from the base end 48 of the drum front wall 52 connected to the drum bottom wall 53 toward the free end 49 of the extension portion 63 such that the free end 49 is farther away from the photosensitive drum 20 than the base end 48 from the photosensitive drum 20, as illustrated in FIG. 3A. With this configuration, a relatively larger space can be secured between the extension portion 63 and the drum-accommodating portion 67.

That is, the space for placing the developing cartridge 19 in the accommodated position can be reliably secured in the cartridge-mounting portion 68 of the drum cartridge 18.

(6) Further, the length L1 from the base end 48 of the drum front wall 52 to the free end 49 of the extension portion 63 is set to be greater than the length L2 of the drum-accommodating portion 67 in the vertical direction, as illustrated in FIG. 3A.

Hence, the space between the extension portion 63 and the drum-accommodating portion 67 can be increased with a simple structure. As a result, the space for placing the developing cartridge 19 in the accommodated position can be secured in the cartridge-mounting portion 68 of the drum cartridge 18 more reliably.

(7) Further, the drum frame 50 has the collar-receiving grooves 59, as illustrated in FIGS. 3A and 3B.

Hence, the operation for mounting and removing the developing cartridge 19, from which the roller cover 110 is detached, relative to the cartridge-mounting portion 68 can be performed smoothly.

Further, the collar-receiving grooves 59 are formed closer to the drum bottom wall 53 than the rotation axis A of the photosensitive drum 20 to the drum bottom wall 53. In other words, the collar-receiving grooves 59 are positioned further downward than the rotation axis A of the photosensitive drum 20. Thus, as compared to a case where the collar-receiving grooves 59 are positioned further upward than the rotation axis A of the photosensitive drum 20, a relatively larger space in the vertical direction can be secured in the cartridge-mounting portion 68.

Therefore, the space for placing the developing cartridge 19 in the accommodated position can be increased in the cartridge-mounting portion 68, while allowing a smooth operation for mounting and removing the developing cartridge 19 relative to the cartridge-mounting portion 68.

(8) Further, the developing cartridge 19 is provided with the developing-cartridge grip portions 77, as illustrated in FIG. 5.

Hence, the user can grip the developing-cartridge grip portions 77 when the developing cartridge 19 is mounted in and removed from the cartridge-mounting portion 68. Therefore, the operation for mounting and removing the developing cartridge 19 relative to the cartridge-mounting portion 68 can be performed smoothly.

Further, when the developing cartridge 19 is at the accommodated position, the developing-cartridge grip portions 77 are respectively disposed on the outer left and right sides of the pressure-receiving portions 65 such that the extension portion 63 are interposed between the developing-cartridge grip portions 77, as illustrated in FIGS. 6 and 9. Therefore, when the developing cartridge 19 is placed in the accommodated position, interference between the developing-cartridge grip portions 77 and the extension portion 63 can be suppressed. Moreover, left-right movement of the developing cartridge 19 disposed at the accommodated position relative to the drum cartridge 18 can be restricted.

(9) Further, the drum-accommodating portion 67 is provided with the rib 62, and the roller cover 110 is provided with the rib abutting portions 121, as illustrated in FIG. 12.

The rib 62 contacts the rib abutting portions 121 when the developing cartridge 19 is at the accommodated position. With this configuration, the photosensitive drum 20 accommodated in the drum-accommodating portion 67 can be separated from the roller cover 110.

As a result, even if vibration is applied to the printer 1, in which the process cartridge 15 is accommodated in the main casing 2, during its transportation, frictional contact between the photosensitive drum 20 and the roller cover 110 can be suppressed, and thus, damages to the photosensitive drum 20 can be suppressed.

(10) Further, the roller cover 110 has the pair of cover side portions 117 on the left and right end portions thereof, as illustrated in FIG. 5.

As illustrated in FIGS. 7A and 7B, when the developing cartridge 19 is at the accommodated position, the pair of cover side portions 117 is disposed below the rib 62, facing the rib 62 with a gap therebetween.

With this arrangement, the developing cartridge 19 can be reliably placed in the accommodated position. As a result, the developing cartridge 19 can be reliably disposed at the accommodated position, while allowing the photosensitive drum 20 to be separated from the roller cover 110.

(11) Further, the cartridge-accommodating portion 150 of the printer 1 is configured to accommodate the process cartridge 15 in which the developing cartridge 19 is disposed at the accommodated position, as illustrated in FIG. 12.

With this configuration, when the printer 1 is shipped and transported, the cartridge-accommodating portion 150 can accommodate therein the process cartridge 15 in which the developing cartridge 19 is disposed at the accommodated position. Hence, the package size of the printer 1 for transportation can be reduced and permanent deformation of the developing roller 34 can be suppressed.

(12) Further, the handle portion 64 is provided in the extension portion 63, and the protruding portions 71 are provided in the developing cartridge 19, as illustrated in FIG. 9.

Hence, as illustrated in FIG. 12, when the process cartridge 15 is accommodated in the cartridge-accommodating portion 150, for example, the user can grip the handle portion 64. This improves the operability of the process cartridge 15.

When the developing cartridge 19 is at the accommodated position, as illustrated in FIG. 9, left-right movement of the developing cartridge 19 at the accommodated position relative to the drum cartridge 18 can be restricted since the protruding portions 71 of the developing cartridge 19 each face the handle portion 64 in the left-right direction.

(13) Further, in the printer 1, as illustrated in FIG. 12, the top cover 7 can be placed in the closed position in a state where the process cartridge 15, in which the developing cartridge 19 is disposed at the accommodated position, is accommodated in the cartridge-accommodating portion 150.

Hence, the package of the printer 1 for transportation can be reduced in size further. Moreover, since the top cover 7 can be placed in the closed position, unexpected separation of the process cartridge 15 from the main casing 2 during transportation of the printer 1 can be suppressed.

(14) Further, the top cover 7 includes the pressing portions 10, as illustrated in FIG. 13.

With this configuration, if the process cartridge 15 is still in the process of being accommodated in the cartridge-accommodating portion 150 (if the process cartridge 15 is not fully accommodated in the cartridge-accommodating portion 150) when the top cover 7 is moved from the open position toward the closed position, the pressing portions 10 will press the extension portion 63 of the process cartridge 15. As the top cover 7 continues to move, the process cartridge 15 is moved from a position in the process of being accommodated to a position accommodated in the cartridge-accommodating portion 150.

That is, by moving the top cover 7, the process cartridge 15 can be reliably accommodated in the cartridge-accommodating portion 150. Moreover, since the pressing portions 10 are configured to press the left and right end portions of the extension portion 63, this configuration can suppress the pressing parts 10 from contacting the developing cartridge 19 at the accommodated position.

(15) When the process cartridge 15, in which the developing cartridge 19 is disposed at the accommodated position, is accommodated in the cartridge-accommodating portion 150, at least a portion of the developing cartridge 19 is placed in the exposure space S1, as illustrated in FIG. 12.

In other words, the exposure space S1 is used as part of the space for accommodating the process cartridge 15 in which the developing cartridge 19 is disposed at the accommodated position. That is, the exposure space S1 and the space for accommodating the process cartridge 15 in which the developing cartridge 19 is disposed at the accommodated position are secured in the main casing 2 so as to be shared with each other.

With this arrangement, it is not necessary to secure the exposure space S1 and the space for accommodating the process cartridge 15 in which the developing cartridge 19 is disposed at the accommodated position separately in the main casing 2. Thus, the main casing 2 can be made more compact, which in turn enables the printer 1 to be made more compact.

As a result, the package for transportation of the printer 1 can be reduced in size further.

(16) Further, as illustrated in FIG. 11, the main casing 2 includes the actuator 101, and the developing cartridge 19 includes the detected gear 92.

In a state where the developing cartridge 19 from which the roller cover 110 is detached is mounted in the drum cartridge 18, the detected gear 92 is detected by the actuator 101, as illustrated in FIG. 4.

With this configuration, the actuator 101 can detect information on the process cartridge 15, specifically whether the developing cartridge 19 is mounted or removed and whether the developing cartridge 19 is new or used.

On the other hand, in a state where the developing cartridge 19 to which the roller cover 110 is attached is disposed at the accommodated position as illustrated in FIG. 11, the detected gear 92 is not detected by the actuator 101.

Hence, detection can be made through a simple structure that the developing cartridge 19 from which the roller cover 110 is detached has not been mounted in the drum cartridge 18.

(17) Further, as illustrated in FIG. 3B, the main casing 2 includes the main-casing coupling 133, and the developing cartridge 19 includes the developing-cartridge coupling 89.

With this configuration, in a state where the developing cartridge 19 from which the roller cover 110 is detached is mounted in the drum cartridge 18, the main-casing coupling 133 is fitted with the coupling recess 94 of the developing-cartridge coupling 89 so as to be incapable of rotating relative thereto. As a result, a driving force is transmitted to the developing-cartridge coupling 89 through the main-casing coupling 133, thereby driving the developing roller 34.

On the other hand, in a state where the developing cartridge 19 to which the roller cover 110 is attached is disposed at the accommodated position as illustrated in FIG. 7B, the main-casing coupling 133 does not engage with the developing-cartridge coupling 89.

Hence, in a state where the developing cartridge 19 from which the roller cover 110 is detached is not mounted in the drum cartridge 18, the developing roller 34 can be prevented from being driven, which in turn prevents an image forming operation from being started.

7. Second Embodiment

Next, a second embodiment of the disclosure will be described while referring to FIG. 14.

Figure 14:
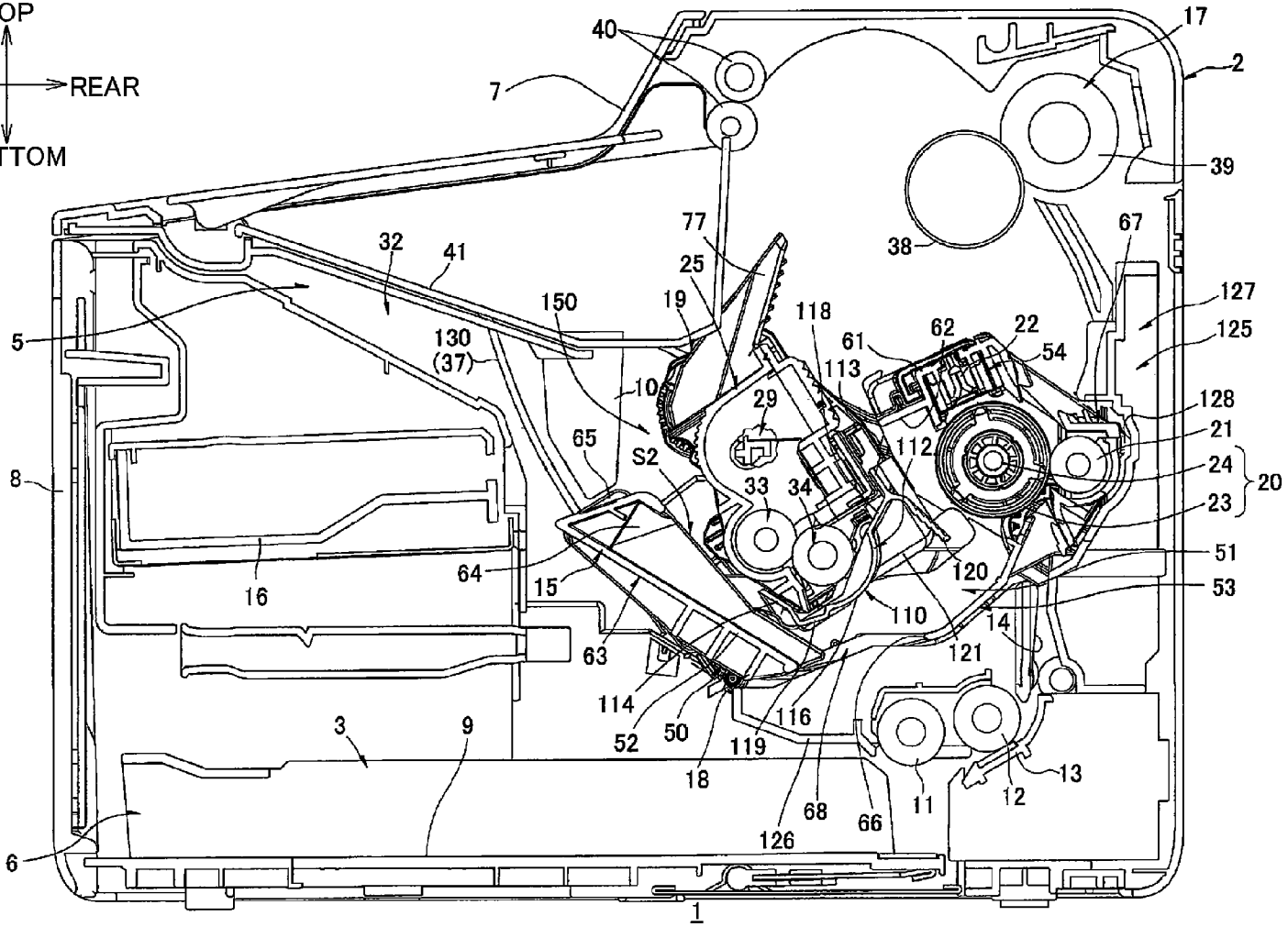
FIG. 14 is a central cross-sectional view of a printer in which a process cartridge provided with a roller cover according to a second embodiment is accommodated in a main casing of the printer.

In FIG. 14, parts corresponding to those in FIGS. 1 through 13 are designated with the same reference numerals to avoid duplicating description.

In the first embodiment, as illustrated in FIGS. 7A and 7B, the developing cartridge 19 placed in the accommodated position is accommodated in the mounting space S2 while being interposed between the cartridge-mounting portion 68 and the extension portion 63. More specifically, the roller cover 110 is disposed on a rear side in the mounting space S2 and the developing-cartridge grip portions 77 are disposed on a front side in the mounting space S2.

In contrast, in the second embodiment, as illustrated in FIG. 14, the developing cartridge 19 placed in the accommodated position is accommodated in the mounting space S2 such that the roller cover 110 is disposed on a bottom side in the mounting space S2 and the developing-cartridge grip portions 77 are disposed on a top side in the mounting space S2.

In the second embodiment described above, in a state where the developing cartridge 19 is disposed at the accommodated position, the process cartridge 15 can be accommodated in the cartridge-accommodating portion 150 of the main casing 2 and the top cover 7 can be placed in the closed position.

Therefore, the second embodiment can obtain the same operational advantages described above in the first embodiment.

Further, since the developing-cartridge grip portions 77 of the developing cartridge 19 placed in the accommodated position is disposed on the top side, the user can easily grips the developing-cartridge grip portions 77 by placing the top cover 7 in the open position.

Therefore, only the developing cartridge 19 to which the roller cover 110 is attached can be removed from the main casing 2 easily, and the operation for mounting and removing the developing cartridge 19 relative to the main casing 2 can be performed smoothly.

8. Variations of Embodiments

The printer 1 described above is an example of the image forming apparatus of the disclosure, but the disclosure is not limited to the embodiments described above.

In addition to the monochromatic printer described above, the image forming apparatus of the disclosure may be configured as a color printer.

When configured as a color printer, the image forming apparatus may be configured as a direct tandem type color printer provided with a plurality of photosensitive drums and a recording medium conveying member; or as an intermediate-transfer tandem type color printer provided with a plurality of photosensitive drums, an intermediate transfer body, and a transfer member.

Instead of the developing roller 34 described above, a developing sleeve, a developing belt, a brush roller, or other member may be used as a developer carrier.

These variations can also obtain the same operational advantages described above in the first and second embodiments.

Note that the first and second embodiments and the variations described above may also be arbitrarily combined.

While the description has been made in detail with reference to the embodiments thereof, it would be apparent to those skilled in the art that various changes and modifications may be made therein without departing from the spirit of the disclosure.

What is claimed is:

1. A cartridge comprising:

a drum cartridge including:

a photosensitive drum;

a charger configured to charge a circumferential surface of the photosensitive drum;

a first side wall and a second side wall spaced apart from each other in an axial direction of the photosensitive drum, the photosensitive drum being supported by the first side wall and the second side wall; and a top wall connecting the first side wall and the second side wall, the top wall covering the charger;

a developing cartridge including a developer roller; and a resin member being detachably attached to the developing cartridge, the resin member separating the developing roller from the photosensitive drum, the resin member including a handle, and the resin member being positioned between the charger and the developing cartridge, wherein the resin member is positioned between the top wall and the developing cartridge.

2. The cartridge as claimed in claim 1, wherein the developing roller includes:

a developing roller shaft having a first shaft end and a second shaft end;

a first collar covering the first shaft end; and a second collar covering the second shaft end, wherein the first side wall includes a first collar-receiving groove having a general U-shape and the second side wall includes a second collar-receiving groove having a general U-shape, and wherein the first collar-receiving groove and the second collar-receiving groove receive the first shaft end and the second shaft end, respectively.

3. The cartridge as claimed in claim 1, wherein the developing roller includes:

a developing roller shaft having a first shaft end and a second shaft end; and a rubber roller body covering the developing roller shaft between the first shaft end and the second shaft end, wherein a length of the resin member in an axial direction is larger than a length of the rubber roller body in the axial direction.

4. The cartridge as claimed in claim 3, wherein the resin member faces the circumferential surface of the rubber roller body with a gap.

5. The cartridge as claimed in claim 1, wherein the handle is provided on a center of the resin member in an axial direction.

6. The cartridge as claimed in claim 5, wherein the handle has a general plate shape.

7. The cartridge as claimed in claim 1, wherein the developing roller includes:

a developing roller shaft having a first shaft end and a second shaft end; and a rubber roller body covering the developing roller shaft between the first shaft end and the second shaft end, wherein the resin member faces the circumferential surface of the rubber roller body with a gap.

8. The cartridge as claimed in claim 7, wherein the handle is provided on a center of the resin member in an axial direction.

9. The cartridge as claimed in claim 8, wherein the handle has a general plate shape.

10. An image forming apparatus drum cartridge comprising:

a cartridge comprising:

a drum cartridge including:

a photosensitive drum;

a charger configured to charge a circumferential surface of the photosensitive drum;

a first side wall and a second side wall spaced apart from each other in an axial direction of the photosensitive drum, the photosensitive drum being supported by the first side wall and the second side wall; and a top wall connecting the first side wall and the second side wall, the top wall covering the charger;

a developing cartridge including a developer roller;

a resin member being detachably attached to the developing cartridge, the resin member separating the developing roller from the photosensitive drum, the resin member including a handle, and the resin member being positioned between the charger and the developing cartridge; and a main body including a cartridge accommodating portion accommodating the cartridge, wherein the resin member is positioned between the top wall and the developing cartridge.

11. The image forming apparatus as claimed in claim 10, wherein the developing roller includes:

a developing roller shaft having a first shaft end and a second shaft end;

a first collar covering the first shaft end; and a second collar covering the second shaft end, wherein the first side wall includes a first collar-receiving groove having a general U-shape and the second side wall includes a second collar-receiving groove having a general U-shape, and wherein the first collar-receiving groove and the second collar-receiving groove receive the first shaft end and the second shaft end, respectively.

12. The image forming apparatus as claimed in claim 10, wherein the developing roller includes:

a developing roller shaft having a first shaft end and a second shaft end; and a rubber roller body covering the developing roller shaft between the first shaft end and the second shaft end, wherein a length of the resin member in an axial direction is larger than a length of the rubber roller body in the axial direction.

13. The image forming apparatus as claimed in claim 12, wherein the resin member faces the circumferential surface of the rubber roller body with a gap.

14. The image forming apparatus as claimed in claim 10, wherein the handle is provided on a center of the resin member in an axial direction.

15. The image forming apparatus as claimed in claim 14, wherein the handle has a general plate shape.

16. The image forming apparatus as claimed in claim 10, wherein the developing roller includes:

a developing roller shaft having a first shaft end and a second shaft end; and a rubber roller body covering the developing roller shaft between the first shaft end and the second shaft end; and wherein the resin member faces the circumferential surface of the rubber roller body with a gap.

17. The image forming apparatus as claimed in claim 16, wherein the handle is provided on a center of the resin member in an axial direction.

18. The image forming apparatus as claimed in claim 17, wherein the handle has a general plate shape.

19. The image forming apparatus as claimed in claim 10, wherein the main body includes:

a cartridge access opening through which the cartridge is accommodated in the cartridge accommodating portion; and an access cover configured to move between an open position for opening the cartridge access opening and a closed position for closing the cartridge access opening, the access cover being provided at the closed position when the cartridge is accommodated in the cartridge accommodating portion.

20. The image forming apparatus as claimed in claim 19, wherein the photosensitive drum is configured to rotate about a rotation axis extending in an axial direction, and wherein the access cover includes a pair of pressing portions configured to press axial end portions of the cartridge in conjunction with movement of the access cover from the open position to the closed position when the cartridge is in a process of being accommodated in the cartridge accommodating portion.

21. The image forming apparatus as claimed in claim 10, wherein the main body includes an exposure device configured to irradiate a laser beam toward the photosensitive drum, wherein the main body has an exposure space defined between the exposure device and the photosensitive drum, the exposure space allowing the laser beam to pass therethrough, and wherein the cartridge is configured to be accommodated in the cartridge accommodating portion such that at least a part of the cartridge is positioned in the exposure space.

* * * * *